US008261703B2

(12) United States Patent
Yoshikawa et al.

(10) Patent No.: US 8,261,703 B2
(45) Date of Patent: Sep. 11, 2012

(54) VARIABLE STROKE ENGINE

(75) Inventors: Taichi Yoshikawa, Wako (JP); Shigekazu Tanaka, Wako (JP); Jiro Fujimoto, Wako (JP); Keitaro Nakanishi, Wako (JP); Noriaki Fujii, Wako (JP); Akinori Maezuru, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 750 days.

(21) Appl. No.: 12/441,352

(22) PCT Filed: Sep. 7, 2007

(86) PCT No.: PCT/JP2007/000972

§ 371 (c)(1),
(2), (4) Date: Mar. 13, 2009

(87) PCT Pub. No.: WO2008/032439

PCT Pub. Date: Mar. 20, 2008

(65) Prior Publication Data

US 2010/0006069 A1 Jan. 14, 2010

(30) Foreign Application Priority Data

| | | |
|---|---|---|
| Sep. 15, 2006 | (JP) | 2006-250937 |
| Sep. 15, 2006 | (JP) | 2006-250946 |
| Sep. 25, 2006 | (JP) | 2006-259576 |
| Nov. 8, 2006 | (JP) | 2006-303125 |

(51) Int. Cl.
*F02B 75/04* (2006.01)
*F02D 15/02* (2006.01)

(52) U.S. Cl. ..... 123/48 B; 123/78 E; 123/78 F

(58) Field of Classification Search ..... 123/48 B, 123/78 E, 78 F
See application file for complete search history.

(56) References Cited

U.S. PATENT DOCUMENTS 6,550,436 B2 * 4/2003 Nohara et al. ..... 123/90.16
(Continued)

FOREIGN PATENT DOCUMENTS

JP 10-131916 5/1998
(Continued)

OTHER PUBLICATIONS

International Preliminary Report on Patentability for Application No. PCT/JP2007/000972, dated Mar. 17, 2009.

*Primary Examiner* — Noah Kamen
*Assistant Examiner* — Grant Moubry
(74) *Attorney, Agent, or Firm* — Nelson Mullins Riley & Scarborough LLP; Anthony A. Laurentano

(57) ABSTRACT

In a variable stroke engine comprising a plurality of links (60, 61) connecting a piston (11) with a crankshaft (30), a control member (65) disposed on an engine main body so as to be moveable in two directions over a prescribed range relative to the engine main body, a control link (63) connecting one of the plurality of links with the control member and an actuator (AC) for displacing the control member, the actuator comprises a ratchet mechanism that utilizes a force transmitted from the piston to the control member as an actuating force for the control member. By providing a spring member (73, SP, 121) that applies a biasing force to the control member, an appropriate actuating force can be applied to the control member in either direction.

11 Claims, 25 Drawing Sheets

U.S. PATENT DOCUMENTS

| | | | | |
|---|---|---|---|---|
| 6,575,128 | B2 * | 6/2003 | Nakamura et al. | 123/90.16 |
| 6,595,186 | B2 * | 7/2003 | Hiyoshi et al. | 123/406.29 |
| 6,647,935 | B2 * | 11/2003 | Aoyama et al. | 123/90.16 |
| 7,059,280 | B2 * | 6/2006 | Nohara et al. | 123/48 D |
| 7,234,424 | B2 * | 6/2007 | Tanaka et al. | 123/48 B |
| 2002/0023603 | A1 * | 2/2002 | Nohara et al. | 123/90.15 |
| 2006/0236960 | A1 * | 10/2006 | Nakamura et al. | 123/90.15 |

FOREIGN PATENT DOCUMENTS

| | | |
|---|---|---|
| JP | 2003322036 | 11/2003 |
| JP | 2004150353 | 5/2004 |
| JP | 2004-324464 | 11/2004 |
| JP | 2002-76555 | 3/2005 |
| JP | 2005-140108 | 6/2005 |

* cited by examiner

Fig.6a
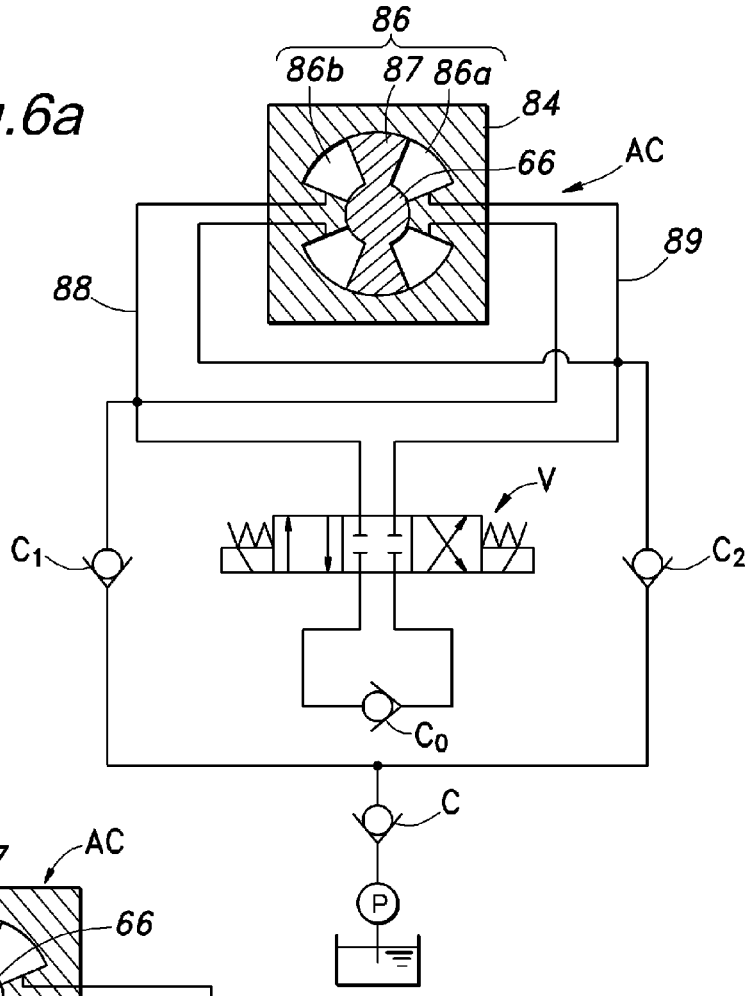
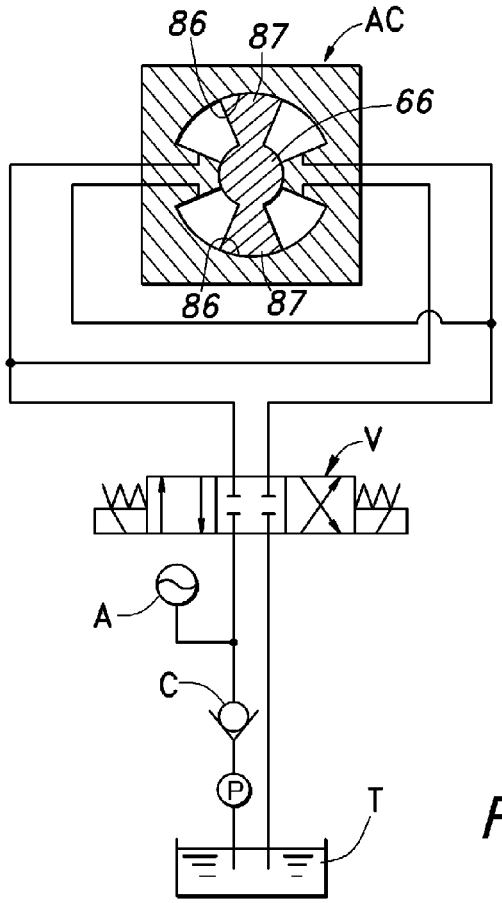
Fig.6b low compression ratio

VARIABLE STROKE ENGINE

RELATED APPLICATIONS

This application is a 35 U.S.C. 371 national stage filing of International Application No. PCT/JP2007/000972, filed on Sep. 7, 2007, which claims priority to Japanese Patent Application No. 2006-250946 filed on Sep. 15, 2006, Japanese Patent Application No. 2006-250937 filed on Sep. 15, 2006, Japanese Patent Application No. 2006-259576 filed on Sep. 25, 2006, and Japanese Patent Application No. 2006-303125 filed on Nov. 8, 2006 in Japan. The contents of the aforementioned applications are hereby incorporated by reference.

TECHNICAL FIELD

The present invention relates to a variable stroke internal combustion engine, and in particular to a variable stroke engine that can simplify the power actuator for changing the stroke property.

PRIOR ART

Known is a variable stroke engine that comprises a plurality of links connecting a piston with a crankshaft, and a control link connecting one of the plurality of links with an control shaft supported by an engine main body so that the piston stroke may be varied by turning the control shaft. As actuating devices for turning the control shaft, those using servo motors and worm reduction gear devices are known (see Japanese patent laid open (kokai) publication no. 2004-150353).

According to the structure disclosed in Patent Document #1, a resilient force of a torsion spring or a downward force of a piston during an expansion stroke is used as a rotational torque for displacing the control shaft from a high compression ratio position to a low compression ratio position so that the speed of displacing the control shaft from the high compression ratio position to the low compression ratio position may be increased. As can be readily appreciated, when displacing the control shaft from the low compression ratio position to the high compression ratio position, because the resilient force of the torsion spring and the downward force of the piston oppose the force for this displacement, the servo motor must produce an adequate torque to overcome this resistance. Therefore, this prior art prevents the use of a servomotor which is compact and consumes little power.

It is known in a variable stroke engine to provide a spring biasing means in the actuator so as to assist the transition of the compression ratio from the high compression ratio to the low compression ratio so that the occurrence of a high load, high compression ratio condition owing to a delay in the speed of changing the compression ratio can be avoided, and also the frequency of the occurrence of abnormal combustion (engine knocking) owing to the self ignition of the fuel can be reduced (see Japanese patent laid open (kokai) publication no. 2004-150353).

In such a variable stroke engine, because the spring biasing means associated with the actuator is provided separately from the actuator, the actuator attached with the spring biasing means requires a large mounting space. This, combined with the need to avoid the interference of the spring biasing means with the surrounding component parts, caused the size of the engine to be come undesirably large.

It is desirable to operate a reciprocating internal combustion engine always at an optimum compression ratio by changing the compression ratio depending on the operating condition of the engine. To accomplish this goal, various variable compression ratio engines have been proposed, and such engines typically comprise an upper link pivotally connected to a piston of the engine, a lower link connecting the upper link to the crankpin of a crankshaft, an control shaft extending along a row of cylinders, a control cam provided on the control shaft in an eccentric relationship, a control link connecting the control cam to the upper link or lower link, and a rotary actuator for angularly actuating the control shaft.

In such a variable compression ratio engine, a large force pushes down the piston during the expansion stroke, and a component of this force is transmitted to the control shaft via the link mechanism so that the control shaft is thereby continually subjected to a force in a certain direction. Therefore, a relatively small actuating force can angularly actuate the control shaft in this direction, but a relatively large actuating force is required to angularly actuate the control shaft in the opposite direction because the link mechanism is required to be actuated against the component of the force transmitted from the piston.

It was proposed to provide a hydraulic piston that acts on the control shaft via a slider mechanism in such a variable compression ratio engine to reduce the load transmitted from the control shaft to the rotary actuator and control an undesired rotation of the control shaft (see Japanese patent laid open (kokai) publication No. 2003-322036).

Also, in Japanese patent laid open (kokai) publication no. 2004-150353, to speed up the transition from a high compression ratio condition of an engine to a low compression condition, it is proposed to interpose a spiral spring between an end of the control shaft and the cylinder block so that the control shaft may be angularly biased toward the low compression ratio position.

However, according to the conventional variable compression ratio engines disclosed in Japanese patent laid open (kokai) publication no. 2004-150353 and Japanese patent laid open (kokai) publication No. 2003-322036, because of the need for a hydraulic circuit including a hydraulic pump, a hydraulic actuator and a control valve, the increased complexity of the system complicates the manufacturing process and causes an increase in the size and weight of the system.

Also, according to the conventional variable compression ratio engine disclosed in Japanese patent laid open (kokai) publication no. 2004-150353, because a spiral spring is attached to an end of the control shaft, the size of the engine in the axial direction of the control shaft has to be increased. In particular, when a relatively large torque is required, the wire diameter of the spiral spring has to be increased, and the diameter of the spiral spring may become so great that there may be some difficulty in installing the spiral spring in the engine. If the spiral spring is closely wound so as to reduce the overall diameter of the spiral spring, the friction between adjacent turns of the coil wire causes a hysteresis that prevents the generation of an appropriate torque.

Even when a torsion coil spring is used in a similar arrangement, the tilting of the coil spring may cause a hysteresis. Again, when the diameter of the coil wire is increased to ensure a required torque to be produced and the number of turns is increased to ensure a required range of rotational angle, the size of the coil spring in the axial direction of the control shaft inevitably increases, and this causes a problem when installing the coil spring in the engine. Be it a spiral spring or a torsion coil spring, the spring constant is fixed, and the torque property that can be obtained is limited to a linear one.

BRIEF SUMMARY OF THE INVENTION

In view of such problems of the prior art, a primary object of the present invention is to provide a novel variable stroke engine free from such problems of the prior art.

A second object of the present invention is to provide an improved variable stroke engine that can simplify the power actuator means for angularly actuating an control shaft.

A third object of the present invention is to provide a variable stroke engine that can apply a biasing torque to the control shaft at an appropriate level for driving the control shaft in either direction without increasing the size of the engine in the direction of the control shaft, and that can offer a high level of freedom in designing the biasing torque.

A fourth object of the present invention is to provide a variable stroke engine that can apply a biasing torque to the control shaft at an appropriate level for driving the control shaft in either direction without increasing the weight of the engine, and that can offer a high level of freedom in designing the biasing torque.

According to the present invention, at least part of such objects can be accomplished by providing a variable stroke engine, comprising; a plurality of links connecting a piston with a crankshaft; a control member disposed on an engine main body so as to be moveable in two directions over a prescribed range relative to the engine main body; a control link connecting one of the plurality of links with the control member; and an actuator for displacing the control member; wherein the actuator comprises a ratchet mechanism that utilizes a force transmitted from the piston to the control member as an actuating force for the control member.

According to this arrangement, because the reciprocating movement of the piston is utilized for moving the connecting point between the control link and engine main body in either direction, the external actuator may consist of a highly compact one or may be totally done away with, and this provides a significant improvement in simplifying the displacing means for the control link. Although the "ratchet mechanism" in a narrow meaning may mean a combination of a toothed wheel and a pawl allow effective motion in one direction only, this term as used herein means not only the vane-type actuator combined with a suitable hydraulic circuit shown in the illustrated embodiments but also other devices such as a linear piston/cylinder device.

According to a preferred embodiment of the present invention, the ratchet mechanism comprises a hydraulic chamber separated into a first and second hydraulic chamber by a piston, a check valve having a first and second end, and a switching valve having three positions for selectively connecting the first and second chambers to the check valve, the three positions including a first position connecting the first and second chambers with the first and second ends of the check valve, respectively, a second position connecting the first and second chambers with the second and first ends of the check valve, respectively, and a third position closing the first and second chambers.

If the engine further comprises a spring member that biases the control member in one of the two directions, the shortfall in the actuating force provided by the inertia force of the piston undergoing a reciprocating movement can be filled by the spring force, and by suitably adjusting the supplementary input, the displacing speed of the connecting point may be accelerated when moving from the high compression ratio side to the low compression ratio side, and the compression ratio can be quickly changed so that engine knocking can be avoided when rapidly accelerating the engine. Such a spring member may consist of a torsion coil spring, but may also consist of a compression coil spring interposed between an arm of the control shaft and an engine main body.

If the spring member is at least partly received in a housing wall of the actuator or is otherwise at least partly received in a part of the actuator, the size of the actuator fitted with the spring biasing means can be minimized, and the spring biasing means is prevented from interfering with the other component parts so that the reliability of the actuator can be enhanced. In particular, if the spring member is received at least partly received in drive shaft of the actuator, the internal space of the drive shaft is effectively utilized, and the size of the actuator can be both reduced.

If the spring member extends at least partly along a bearing journal of the drive shaft, the weight of the drive shaft can be reduced, and the size of the actuator can be even further reduced.

If the one end the spring member is engaged by an engagement opening formed in an end wall of the drive shaft, and the other end thereof is engagement by an engagement opening formed in the housing of the actuator, the engagement openings both opening out outwardly, states of engagement can be confirmed from outside.

DETAILED DESCRIPTION OF THE PREFERRED EMBODIMENT(S)

Now the present invention is described in the following in more detail in terms of concrete embodiments with reference to the appended drawings. In various embodiments of the present invention, like parts are denoted with like numerals without repeating description of such parts. Also, as can be readily appreciated by a person skilled in the art, various variations of one embodiment are applicable to any other embodiments although the description may not cover every such possibility.

FIGS. 1 to 4 are simplified views of a variable compression ratio/displacement engine given as an embodiment of the variable stroke engine of the present invention with an upper part thereof such as a cylinder head omitted from the drawings. A piston 11 that is slidably received in a cylinder 5 of the engine is connected to a crankshaft 30 via a pair of links consisting of a upper link 61 and a lower link 60. The valve actuating mechanism, exhaust system and intake system of this engine are not described as they may be similar to those of conventional four-stroke engines.

The crankshaft 30 is essentially identical to that of a conventional fixed compression ratio engine, and comprises a crank journal 30J (rotational center of the crankshaft) supported in a crankcase 4 and a crankpin 30P which is radially offset from the crank journal. An intermediate point of the lower link 60 is supported by the crankpin 30P so as to be able to tilt like a seesaw. An end 60*a* of the lower link 60 is connected to a big end 61*b* of the upper link 61, and a small end 61*a* of the upper link 61 is connected to a piston pin 13. A counterweight is provided in association with the crankshaft 30 so as to cancel a primary rotary oscillation component of the piston movement, but is not shown in the drawings as it is not different from that of a conventional engine.

The other end 60*b* of the lower link 60 is connected to a small end 63*a* of a control link 63 which is similar in structure to a connecting rod that connects a piston with a crankshaft in a normal engine. A big end 63*b* of the control link 63 is connected to an eccentric portion 65P of a control shaft 65, which is rotatably supported by the crankcase 4 and extends in parallel with the crankshaft 30, via a bearing bore formed by using a bearing cap 63*c*.

The control shaft 65 includes a journal portion 65J (rotational center of the control shaft) which is provided in a suitable part of the engine main body, and the eccentric portion 65J supports the big end 63*b* of the control link 63 so as to be movable in the crankcase 4 within a prescribed range (about 90 degrees in the illustrated embodiment). The rotational angle of the control shaft 65 can be continually varied and retained at a desired angle by a hydraulic ratchet mechanism (which will be described hereinafter) provided in a suitable part of the crankcase 4. This forms the displacing means for changing the position of the connecting point of the control link 63 on the engine main body.

In this engine, by rotatively actuating the control shaft 65, the position of the big end 63*b* of the control link 63 can be moved between the position (horizontally inward position/low compression ratio) illustrated in FIGS. 1 and 2 and the position (vertically downward position/high compression ratio) illustrated in FIGS. 3 and 4, and this causes a corresponding change in the swinging angle of the lower link 60 in response to the rotation of the crankshaft 30. This causes a continuous change in the effective length of the connecting rod that connects the piston 11 with the crankshaft 30 in response to the reciprocating movement of the piston 11, and this in effect allows a change in at least one of the compression ratio and displacement of the engine to be effected as desired by suitably changing the position for supporting the control link 63 with respect to the crankcase 4 by rotatively actuating the control shaft 65.

In other words, a piston stroke varying mechanism is formed by the upper link 61, lower link 60, control link 63 and control shaft 65. Thereby, the stroke of the piston 11 within the cylinder 5 or the positions of the top dead center and bottom dead center can be varied continuously between the one extreme state indicated by letter A in FIG. 2 and the other extreme state indicated by letter B in FIG. 4.

In this variable stroke engine, as the crankshaft 30 turns owing to the downward force of the piston caused by the combustion of fuel during the expansion stroke, a tensile force is applied to the control link 63 via the lower link 60 supported by the crankpin 30P. This is transmitted to the eccentric portion 65P of the control shaft 65, and this creates a torque that tends to turn the control shaft 65 from the high compression ratio position to the low compression ratio position (in clockwise direction in the drawings).

The downward force acting on the piston starts increasing at a time point immediately before the top dead center, reaches a maximum value during the combustion, and virtually disappears in the latter part of the expansion stroke. The inertia force of the piston as it moves upward causes a downward force on the control link 63, and this cause a torque that tends to turn the control shaft from the low compression ratio position to the high compression ratio position (counter clockwise direction in the drawings). Therefore, the control shaft 65 is subjected to an alternating torque as illustrated in FIG. 5 owing to the reciprocating movement of the piston 11. The present invention makes use of this alternating torque to angularly actuate the control shaft 65. In the following is described the hydraulic ratchet mechanism AC which is constructed as an input means for inputting the force generated by the reciprocating movement of the piston 11 to the control shaft 65 with reference to FIG. 6*a*.

Between the control shaft 65 and the crankcase 4 is provided a hydraulic ratchet mechanism AC consisting of a closed-circuit hydraulic system as shown in FIG. 6*a*. The hydraulic ratchet mechanism comprises a vane shaft (drive shaft) 66 provided with a plurality of vanes 87 and a fixed housing 84 rotatably supporting the vane shaft 66 over a prescribed angular range, and is substantially similar to a vane type rotary actuator in structure. A three-position four-way solenoid valve V is connected between two ends of a check valve $C_0$ and a pair of oil passages 88 and 89 that lead to a pair of oil chambers 86*a* and 86*b* defined on either side of each vane 87, respectively, so that the two oil chambers 86*a* and 86*b* may be connected to the two ends of the check valve $C_0$ in a reversible manner and may also be blocked as desired. Each vane may be considered as forming a rotary piston.

When the vane shaft 66 fitted with the vanes 87 is to be turned only in clockwise direction in FIG. 6*a*, the solenoid valve V is put to the left position VL. Then, the rotation of the vane shaft 66 is permitted only when a clockwise torque is applied thereto, and is prevented by the action of the check valve $C_0$ when a counter clockwise torque is applied thereto.

Conversely, when the vane shaft 66 is to be turned only in counter clockwise direction, the solenoid valve V is put to the right position VR. Then, the rotation of the vane shaft 66 is permitted only when a counter clockwise torque is applied thereto, and is prevented by the action of the check valve $C_0$ when a clockwise torque is applied thereto.

By thus extracting only the part of the alternating torque acting upon the control shaft 65 in one sense, the vane shaft 66 can be angularly actuated in an incremental manner. Once the control shaft 65 has turned to a desired angular position, the solenoid valve V is put to the neutral position VC and the hydraulic pressure in each of the oil chambers 86*a* and 86*b* is sealed off so that the vane shaft 66 is held stationary in this position. Thus, without using any special actuating device, the rotation of the control shaft 65 in either direction and holding of the control shaft 65 at a desired position can be accomplished.

By connecting the outlet passage an oil pump P to the two oil passages 88 and 89 communicating with the oil chambers 86*a* and 86*b*, respectively, via check valves $C_1$ and $C_2$, respectively, in such a direction as to permit flow of oil to the passages 88 and 89, even when an oil leakage develops in the hydraulic ratchet mechanism AC, oil can be quickly replenished.

The hydraulic ratchet mechanism AC is not necessarily required to be of a rotary type but may also be of a linear piston type. In such a case, the actuator may consist of a linear movement/rotary movement conversion mechanism in which an arm is fixed to the control shaft 65, and a piston rod is connected to the free end of the arm. When a linear piston type hydraulic ratchet mechanism AC is used, the mechanism for displacing the connecting point between the control link 63 and engine main body may consist of a slide mechanism for linearly displacing the big end 63*b* of the control link 63 instead of the control shaft 65 which is configured to undergo an angular movement as discussed above.

The durability of the hydraulic ratchet mechanism AC can be improved by controlling the range of the angular movement of the vane shaft 66 so that the vane shaft 66 may stop short of the circumferential end surface of each oil chamber 86*a* and 86*b* of the fixed housing 84 as it undergoes an angular movement, and thereby preventing each vane 87 from striking the circumferential end surfaces of the corresponding oil chambers 86*a* and 86*b*.

As shown in FIG. 7, the fixed housing 84 of the ratchet mechanism AC is formed by an intermediate housing HUm internally defining the oil chambers 86*a* and 86*b*, an outer housing HUo attached to an engine main body such as a crankcase wall and an inner housing HUi facing the control link that are joined to one another by using gaskets and threaded fastening bolts.

As can be appreciated from the foregoing description, when angularly actuating the control shaft 65, the transition from the high compression ratio position to the low compression ratio position is effected by using the torque represented by area a in FIG. 5, and the transition from the low compression ratio position to the high compression ratio position is effected by using the torque represented by area b in FIG. 5. If area b does not exist, the transition from the low compression ratio position to the high compression ratio position becomes impossible. To eliminate such a problem, as shown in FIG. 7, a supplementary input applying means such as a torsion coil spring 73 having one end 73 fixed to the crankcase 4 and another end 73 fixed to the vane shaft 66 is provided to the hydraulic ratchet mechanism AC so that the reversing position of the alternating torque acting on the control shaft 65 can be set at a desired position by suitably selecting the supplementary torque produced by the torsion coil spring 73. For instance, when the reversing position is set so that the torque levels of the two senses are equal to each other, the sizes of area a and area b may be made substantially equal to each other as illustrated in FIG. 5. Thereby, the switching speed of the transition from the high compression ratio position to the low compression ratio position can be made substantially equal to that of the transition from the low compression ratio position to the high compression ratio position.

When the supplementary torque produced by the torsion coil spring 141 is selected so that the rotational speed of the control shaft may differ from one direction to another, and the reversing position of the alternating torque is lowered as indicated by the double-dot chain-dot line in FIG. 5, the displacing speed of the big end 63*b* of the control link 65 from the high compression ratio position to the low compression ratio position can be made higher than that from the low compression ratio position to the high compression ratio position, and the compression ratio can be changed in a highly responsive manner when accelerating the engine without causing engine knocking. If the spring force of the torsion coil spring 141 is selected so as to turn the control shaft from the high compression ratio position to the low compression ratio position when the engine is stopped, and the oil pressure is lost from the hydraulic ratchet mechanism AC, because the engine is always in the low compression ratio condition when starting the engine, the starting of the engine is facilitated.

In the embodiment illustrated in FIG. 7, the torsion coil spring 73 is received in a recess 74 formed on the outer face of the outer housing HU0. The recess 74 may have an adequate depth to fully receive the torsion coil spring 73 or may have a smaller depth so that the torsion coil spring 73 may be received therein in cooperation with a corresponding recess (not shown in the drawing) formed in the corresponding part of the engine main body such as a crankcase wall.

The hydraulic circuit for a vane-type hydraulic actuator AC for controlling the variable stroke link mechanism CR, instead of the hydraulic ratchet mechanism AC discussed above, is now described in the following with reference to FIG. 6*b*.

Similarly as the embodiment illustrated in FIG. 6*a*, the two sector shaped vane oil chambers 86 are each separated into the two control oil chambers 86*a* and 86*b* by the corresponding vane 87, and these control oil chambers 86*a* and 86*b* are connected to an oil tank T via the hydraulic circuit which will be described hereinafter. To the hydraulic circuit are connected an oil pump P, a check valve C, an accumulator A and the solenoid switching valve V. The oil pump P, check valve C, accumulator A and solenoid switching valve V form an oil pressure supply device S, and are placed in appropriate parts of the engine main body 1. The solenoid switching valve V is provided inside the valve unit 92 described earlier. The oil pressure supply device S is connected to the solenoid switching valve V via a pair of pipes P1 and P2, and the solenoid switching valve V is connected to the control oil chambers 86*a* and 86*b* via the oil passages 88 and 89 formed in the housing HU.

Therefore, in FIG. 6*b*, when the solenoid switching valve V is switched to a left position VL, the hydraulic pressure produced by the oil pump P is forwarded to the control oil chamber 86*a*, and this hydraulic pressure pushes the vane 87 in the direction to turn the control shaft in counter clockwise direction. Conversely, when the solenoid switching valve V is switched to a right position VR, the hydraulic pressure produced by the oil pump P is forwarded to the control oil chamber 86*b*, and this hydraulic pressure pushes the vane 87 in the direction to turn the control shaft in clockwise direction. Thereby, the phase of the eccentric pin 65P can be changed as desired. To the eccentric pin 65P of the control shaft 65 is pivotally connected the control link 63 of the variable compression ratio mechanism CR so as to enable an angular movement of the control shaft 65 around its axial line. Therefore, by suitably actuating the control shaft 65 (about 90 degrees), the resulting change in the phase of the eccentric pin 65P of the control shaft 65 operates the variable compression ratio mechanism CR in a corresponding manner.

When angularly actuating the drive shaft 66 of the actuator AC and hence the control shaft 65 from the low compression ratio side to the high compression ratio side (counter clockwise in FIGS. 3 and 1), the torsion coil spring 141 is twisted in the direction to store energy. Therefore, the spring force of the torsion coil spring 141 actuates the control shaft 65 from the high compression ratio side to the low compression ratio side (clockwise in FIGS. 1 and 3). Therefore, the actuating force for turning the control shaft from the high compression ratio side to the low compression side consists of a sum of the actuating force owing to the spring force of the torsion coil spring 141 and the actuating force of the actuator AC, and is therefore higher than the actuating force supplied by the actuator AC alone. Therefore, when the compression ratio varying mechanism CR is operated so as to move from the high compression ratio state to the low compression ratio state, the actuating force of the vane-type hydraulic actuator AC and the actuating force of the torsion coil spring 141 act in the same direction so as to accelerate the transition from the high compression ratio state to the low compression ratio state, and enable this transition to be effected in a shorter period of time. Also, any shortage in the actuating force for the control shaft 65 may be compensated by the torsion coil spring 141. Therefore, a high load, high compression ratio situation can be avoided, and the occurrence of abnormal combustion such as engine knocking can be minimized.

According to the illustrated embodiment, because the spring biasing means such as the torsion coil spring 141 is internally provided in the actuator AC, the sized of the actuator fitted with the spring biasing means can be minimized, and the spring biasing means is prevented from interfering with the other component parts so that the reliability of the actuator can be enhanced. A spring member that can store energy is desirable for use as the supplementary input applying means for its simplicity, but other actuators such as pneumatic motors and electric motors may also be used. Also, by suitably modifying the link geometry, the torque that is applied to the control shaft may be made to differ from one rotational direction to another.

As shown in FIGS. 8 to 11, the variable compression ratio engine E given as a second embodiment of the present invention consists of an automotive engine which is laterally placed (with a crankshaft 30 thereof oriented laterally with respect to the traveling direction of the motor vehicle) in the engine room of the motor vehicle not shown in the drawings. The engine E is mounted in the engine room in such a manner that the engine is somewhat tilted rearward or the cylinder axial line L-L is somewhat tilted rearward with respect to a vehicle line V-V (See FIG. 9).

This variable compression ratio engine E consists of an in-line, four-cylinder, four-stroke OHC engine, and an engine main body 1 thereof comprises a cylinder block 2 formed with four cylinders 5 arranged laterally one next another, a cylinder head 3 integrally attached to a deck surface of the cylinder block 2 via a gasket 6, an upper block 40 (upper crankcase) integrally formed in a lower part of the cylinder block 2, and a lower block 41 (lower crankcase) integrally attached to the lower surface of the upper block 40. A crankcase 4 is jointly formed by the upper block 40 and the lower block 41. The upper surface of the cylinder head 3 is closed by a head cover 9 integrally attached thereby via a seal member 8, and an oil pan 10 is integrally attached to the lower surface of the lower block 41 (lower crankcase).

A piston 11 is slidably received in each of the four cylinders 5 of the cylinder block 2, and the part of the lower surface of the cylinder head 3 opposing the piston 11 is formed with a combustion chamber 12 and an intake port 14 and an exhaust port 15 communicating with the combustion chamber 12. An intake valve 16 is provided in the intake port 14, and an exhaust valve 17 is provided in the exhaust port 15, each configured to be selectively opened and closed as required. A valve actuating mechanism 18 is provided on the cylinder head 3 so as to open and close the intake valves 16 and exhaust valves 17. The valve actuating mechanism 18 comprises an intake camshaft 20 and exhaust camshaft 21 rotatably supported by the cylinder head 3, and an intake rocker arm 24 and exhaust rocker arm 25 that are rotatably supported by an intake rocker shaft 22 and exhaust rocker shaft 23, respectively, for each cylinder and functionally intervene between the intake camshaft 20 and intake valve 16 and between the exhaust camshaft 21 and exhaust valve 17, respectively. Thereby, the rotation of the intake and exhaust camshafts 20 and 21 causes the intake and exhaust valves 16 and 17 to be opened and closed at a prescribed timing via the rocking movements of the intake and exhaust rocker arms 24 and 25 against the valve closing forces of valve springs 26 and 27.

As illustrated in FIG. 8, the intake camshaft 20 and exhaust camshaft 21 are actuated by a crankshaft 30 via a per se known synchronized transmission mechanism 28 which is described hereinafter, and turn at half the rotational speed of the crankshaft 30. The valve actuating mechanism 18 is enclosed by the head cover 9 integrally attached to the upper surface of the cylinder head 3. The cylinder head 3 is provided with four cylindrical plug insertion tubes 31 so as to correspond to the four cylinders, and a spark plug 32 is inserted into the cylinder head 3 via each of these plug insertion tubes 3.

The synchronized transmission mechanism 28 is covered by a chain case 29 which is attached to an end of the engine main body 1 corresponding to an axial end of the crankshaft 30. The four intake ports 14 formed so as to correspond to the four cylinders 5 open out from the rear surface of the engine main body 1 or rearward with respect to the vehicle body, and are connected to an intake manifold 34 of an intake system IN. The intake system IN has a per se known structure, and detailed description of this part is omitted from this description.

The four exhaust ports 15 formed so as to correspond to the four cylinders 5 open out from the front surface of the engine main body 1 or forward with respect to the vehicle body, and are connected to an exhaust manifold 35 of an exhaust system EX. The exhaust system EX has a per se known structure, and detailed description of this part is omitted from this description.

As shown in FIGS. 10 and 11, the crankcase 4 consisting of the upper block 40 (upper crankcase) integrally formed in a lower part of the cylinder block 2 and the lower block 41 (lower crankcase) protrudes forwardly (with respect to the vehicle body) beyond the cylinders 5 of the cylinder block 2, and a crankcase chamber CC defined inside this protruding part accommodates a variable compression ratio mechanism CR (which is described hereinafter) that variably adjusts the stroke of the movement of the piston 11. A vane-type hydraulic actuator AC (which is described hereinafter) equipped with a spring biasing means SP for driving this variable compression ratio mechanism CR is provided on the exterior of the engine main body 1, and is located at a position lower than the crankshaft 30.

As can be appreciated from FIGS. 8, 9, 12 and 13, the lower block 41 is attached to the lower surface of the upper block 40, which is integrally formed with the lower part of the cylinder block 2, by using a plurality of connecting bolts 42. A plurality of journal bearings 43 are formed in the interface between the upper block 40 and lower block 41 to support the journals 30J of the crankshaft 30 in a rotatable manner (FIG. 15).

As shown in FIG. 12, the lower block 41 consists of a cast member having a rectangular closed cross section as seen in plan view, and is provided with end bearing members 50 and 51 on the left and right ends thereof, respectively, a central bearing member 54 in a central part thereof, and left and right intermediate bearing members 52 and 53 in intermediate parts thereof. The journals 30J of the crankshaft 30 are supported by these bearing members 50 to 54.

Now referring to FIGS. 10 and 11 once again, the structure of the variable compression ratio mechanism CR for varying the top dead center and bottom dead center positions of the piston 11 and hence the compression ratio between a high compression ratio and a low compression ratio is described in the following. The crankshaft 30, which is rotatably supported in the interface between the upper block 40 and lower block 41 as discussed earlier, is provided with crankpins 30P, and each crankpin 30P pivotally supports an intermediate part of a triangular lower link 60. An end (upper end) of the lower link 60 is pivotally connected to a lower end (big end) of an upper link (connecting rod) 61 via a first connecting pin 62, and the upper link 61 is in turn pivotally connected to a piston pin 13 of the piston 11. Another end (lower end) of the lower link 60 is pivotally connected to an upper end of a control link 63 via a second connecting pin 64. The control link 63 extends downward, and has a lower end which is pivotally connected to an eccentric pin 65P of a crank-shaped control shaft 65. The control shaft 65 is integrally and coaxially connected to the hydraulic actuator AC (which is described hereinafter) so that the control shaft 65 may be angularly actuated by the hydraulic actuator AC over a prescribed angular range (90 degrees, for instance). The resulting phase shift of the eccentric pin 65P causes the control link 63 to be angularly actuated. More specifically, the control shaft 65 can angularly displace between a first position (where the eccentric pin 65P is at a lower position) illustrated in FIG. 10 and a second position (where the eccentric pin 65P is at a higher position) illustrated in FIG. 11. At the first position illustrated in FIG. 10, because the eccentric pin 65P is at a lower position, the control link 63 is pulled down, and the lower link 60 is tilted in clockwise direction around the crankpin 30P of the crankshaft 30. Therefore, the upper link 61 is pushed upward and the piston 11 assumes a higher position with respect to the cylinder 5 so that the engine E is placed under a high compression ratio condition. Conversely, at the second position illustrated in FIG. 11, because the eccentric pin 65P is at a higher position, the control link 63 is pushed up, and the lower link 60 is tilted in counter clockwise direction around the crankpin 30P of the crankshaft 30. Therefore, the upper link 61 is pulled downward and the piston 11 assumes a lower position with respect to the cylinder 5 so that the engine E is placed under a low compression ratio condition.

Thus, an angular displacement of the control shaft 65 around its axial center causes an angular displacement of the control link 63 which in turn causes a change in the constraint on the movement of the lower link 60 so that the stroke property of the piston 11 including the top dead center position is varied, and this enables the compression ratio of the Engine E to be changed at will.

In the illustrated embodiment, as will be discussed hereinafter, a spring biasing means SP provided in association with the vane type hydraulic actuator AC accelerates the actuation of the control shaft 65 in one direction from the high compression ratio to the low compression ratio, and ensures an efficient and stable combustion in the engine by avoiding a high load, high compression ratio situation by compensating for a shortage in the actuating torque for the control shaft 65.

Thus, the variable compression ratio mechanism CR is formed by the upper link 61, first connecting pin 62, lower link 60, second connecting pin 64 and control link 63.

As shown in FIGS. 12, 14 and 16, the control shaft 65 which is connected to the control link 63 and actuates the variable compression ratio mechanism CR is formed as a crankshaft including a plurality of journals 65J and eccentric pins 65P arranged in an alternating fashion, similarly as the engine crankshaft 30. To an end of this control shaft 65 is coaxially connected the hydraulic actuator AC which is described herein after so that the control shaft 65 may be actuated by the hydraulic actuator AC. The control shaft 65 extends in parallel with the crankshaft 30, and is rotatably supported, at a position lower than the crankshaft 30, by the lower block 41 and a bearing block 70 attached to the lower surface of the lower block 41 by using a plurality of connecting bolts 68.

As shown in FIG. 14, the bearing block 70 supporting the control shaft 65 consists of an integrally cast member given with a high rigidity and includes a connecting member 71 extending in the axial direction of the control shaft 65 and a plurality of bearing walls 72 that extend perpendicularly from the connecting member 71 at a regular axial interval. The journals 65J of the control shaft 65 is rotatably supported, via slide bearings, by the bearing portions formed between the upper surfaces of the bearing walls 72 and the lower surfaces of bearing walls 50*a*, 51*a*, 52*a*, 53*a* and 54*a* extending from the respective bearing members 50, 51, 52, 53 and 54 of the lower block 41.

The structure of the hydraulic actuator AC equipped with the spring biasing means SP for driving the control shaft 65 is now described in the following.

As shown in FIGS. 8, 9, 12, 13 and 14, the hydraulic actuator AC has a housing HU which is fixedly attached to an end surface of the engine main body 1 or in particular the lower block 41 thereof corresponding to an axial end of the crankshaft 30 by using a plurality of fastening bolts 93 with the chain case 29 covering the synchronized transmission mechanism 28 interposed between the housing HU and the lower block 41. The housing HU is provided with a hexagonal shape, and includes an inner housing HUi and an outer housing HUo that are joined to each other with a packing interposed between them to internally define a cylindrical vane chamber 80 therein. The vane chamber 80 receives a vane shaft 66 serving as a drive shaft. An inner and outer bearing 66*i*, 66*o* of the vane shaft 66 are rotatably supported by an end wall of the lower block 41 and the outer housing Huo, respectively, via a slide bearing. An inner end of the vane shaft (drive shaft) is connected to an end of the control shaft 65 via a spline coupling 67 in a coaxial relationship so that the torque of the vane shaft 66 can be directly transmitted to the control shaft 65. Furthermore, as illustrated in FIG. 14, the bearing span Si of the inner bearing 66*i* of the vane shaft 66 is greater than the bearing span So of the outer bearing 66*o* of the vane shaft 66 so that an adequate supporting rigidity of the spline coupling 67 is ensured.

An open outer face of the outer housing HUo is sealed off in a liquid tight manner by a cover member 102 fixedly attached thereto by using a plurality of fastening bolts 101. Inside the vane shaft 66 is defined a cylindrical hole 103 having an open outer end and a closed bottom end, and a coil spring SP forming the spring biasing means is received in this cylindrical hole 103. The inner end of the coil spring SP is engaged by an engagement hole 105 formed in a bottom wall 104 of the receiving hole 103, and the outer end thereof is engaged by an engagement hole 106 formed in the cover member 102. The engagement holes 105 and 106 open out toward the exterior of the housing so that the state of engagement of the coil spring SP can be confirmed from the exterior. The engagement hole 106 formed in the cover member 102 is closed by a seal bolt 107 so as to avoid leakage of oil from the receiving hole 103.

The spring force of the coil spring SP urges the control shaft 65 in one direction or in a direction to cause a transition from the high compression side to the low compression side.

As shown in FIG. 13, a pair of sector shaped vane oil chambers 86 are defined at a 180 degree phase difference between the inner circumferential surface of the vane chamber 80 and the outer circumferential surface of the vane shaft (drive shaft) 66. A pair of vanes 87 extending from the outer circumferential surface of the vane shaft 66 are received in the corresponding vane oil chambers 86. The outer circumferential surface of each vane 87 engages the inner circumferential surface of the corresponding vane oil chamber 86 via a packing so that each vane 87 separates the corresponding vane oil chamber 86 into two control oil chambers 86*a* and 86*b* in a liquid tight manner. The housing HU is formed with oil passages 88 and 89 communicating with the control oil chambers 86*a* and 86*b*, respectively, and these oil passages 88 and 89 are also connected to a solenoid valve V of a hydraulic circuit which will be described hereinafter.

As shown in FIGS. 8 to 11 and 13, the front face of the engine main body 1 is formed with a flat mounting surface 90 adjacent to the hydraulic actuator AC, and a valve unit 92 receiving the solenoid valve V (see FIG. 17) of the hydraulic circuit for the hydraulic actuator AC therein is mounted on this mounting surface 90 by using a plurality of threaded bolts 91.

Because the spring biasing means SP is internally provided in a drive shaft 66 of the actuator AC, the internal space of the drive shaft is effectively utilized, and the size of the actuator can be both reduced.

Because the spring biasing means SP extends to a bearing portion of a vane shaft (drive shaft) 66 of the actuator AC, the internal space of the drive shaft is effectively utilized, and the weight of the drive shaft and the size of the actuator can be both reduced.

Because a drive shaft 66 of the actuator AC is internally provided with a receiving hole 103 having a closed bottom, and receiving the spring biasing means SP therein; and the spring biasing means SP has one end engaged by an engagement hole 105 provided in a bottom wall 104 of the receiving hole 103 and another end engaged by an engagement hole 106 provided in a cover member 102 covering the receiving hole 103; the engagement holes 105, 106 opening outwardly from the receiving hole 103, the engagement state of the spring biasing means can be readily confirmed from outside.

For instance, the actuator of the present invention is not limited to hydraulic actuators such as the one used in the illustrated embodiments, but may also consist of various electric actuators. Also, the spline coupling between the drive shaft of the actuator and the control shaft may be replaced with outer coupling means including pressure fitted couplings. The hydraulic circuits described in connection with FIGS. 6*a* and 6*b* are equally applicable to this embodiment, and the same description applies to this embodiment.

The engine E given as a third embodiment of the present invention and illustrated in FIG. 17 consists of an in-line four-cylinder engine, and a vertical sectional view of one of the cylinders is shown in FIG. 17. A piston 11 that is slidably received in the cylinder 5 of the engine E is connected to a crankshaft 30 via an upper link 61 and a lower link 60.

The crankshaft 30 is essentially no different from that of a conventional fixed compression ratio engine, and comprises a crank journal 30J (rotational center of the crankshaft) supported by a crankcase (engine main body) 4 and a crankpin 30P radially offset from the crank journal 30J. An intermediate point of the lower link 60 is supported by the crankpin 30P so as to be able to tilt like a seesaw. An end 60*a* of the lower link 60 is connected to a big end 61*b* of the upper link 61, and a small end 61*a* of the upper link 61 is connected to a piston pin 13.

The other end 60*b* of the lower link 60 is connected to a small end 63*a* of a control link 63 which is similar in structure to a connecting rod that connects a piston with a crankshaft in a normal engine. A big end 63*b* of the control link 63 is connected to an eccentric portion 113 of an control shaft 65, which is rotatably supported by the crankcase 4 and extends in parallel with the crankshaft 30, via a bearing bore formed by using a bearing cap 63*c*.

In a middle part of the control shaft 65 is formed a driven gear 116, and a vane-type hydraulic actuator AC for angularly actuating the control shaft 65 is formed with a drive gear 141 that meshes with the driven gear 116 (see FIG. 18). Thereby, the angular position of the control shaft 65 can be continuously controlled and held at a desired angle according to the operating condition of the engine E. A journal portion provided inside the hydraulic actuator AC is provided with a plurality of vanes projecting radially from the outer periphery thereof, and an oil chamber is defined by the housing for each vane. Each oil chamber is divided into a first oil chamber and a second oil chamber by the corresponding vane so that the rotor may be angularly actuated and retained at a desired position by appropriately supplying and expelling the hydraulic oil into and from these oil chambers. The hydraulic circuits described in connection with FIGS. 6*a* and 6*b* are equally applicable to this embodiment, and the same description applies to this embodiment.

In this engine E, by rotatively actuating the control shaft 65, the position of the big end 63*b* of the control link 63 can be moved from the position illustrated in FIG. 17 in either vertical direction with respect to the neutral axial line of the control shaft 63, and this causes a corresponding change in the swinging angle of the lower link 60 in response to the rotation of the crankshaft 30. Thereby, in response to the change in the swinging angle of the lower link 60, the stroke of the piston in the cylinder 5 or the top dead center and bottom dead center positions of the piston 11 change. Thus provided is a function to vary at least one of the compression ratio and displacement of the engine in a continuous manner.

The control shaft 65 is provided with webs 117, and a web connecting portion 118 (first connecting portion) is formed on an end of each of the webs 117 opposite to the corresponding eccentric pin 13 with respect to the neutral axial line of the control shaft 65. A plurality of main body connecting members 119 each formed with a pair of main body connecting portions 120 (second connecting portion) are attached to the inner surface of the crankcase 4. A compression coil spring device (biasing means) 121 is interposed between each main body connecting portion 120 and the corresponding web connecting portion 118.

Each compression coil spring device 121 is provided with an upper connecting piece (first connecting piece) 122 at an upper then thereof and a lower connecting piece (second connecting piece) 123 at a lower end thereof, each of these connecting pieces are pivotally connected to the corresponding web connecting portion 118 and main body connecting portion 120 via pins (first and second pins) 124 and 125, respectively. Between the upper connecting piece 122 and the lower connecting piece 123 are interposed a pair compression coil springs 126 and 127 that are coaxially nested with each other. The pins 124 and 125 are disposed on the axial line of the compression coil springs 126 and 127.

As shown in FIG. 18, the control shaft 65 includes a first journal 115*a*, a second journal 115*b*, a third journal 115*c*, a fourth journal 115*d* and a fifth journal 115*e* that are arranged from the one end to the other end of the control shaft 65 in this order. Between each adjacent pair of the journals 115 is disposed an eccentric pin 113 and a pair of webs 117 flanking the eccentric pin 113. Thus, a first eccentric pin 113*a* is interposed between the first and second journals 115*a* and 115*b*, a second eccentric pin 113*b* is interposed between the second and third journals 115*b* and 115*c*, and so on. Thus, four eccentric pins 113*a* to 113*d* are provided on a same axial line so as to alternate with the five journals 115.

Each journal 115 is connected to the adjacent eccentric pins 113 via the corresponding webs 117. For instance, the web 117*a* is interposed between the first journal 115*a* and the first eccentric pin 113*a*. Similarly, eight webs 117*a* to 117*h* are arranged so as to correspond to the first to fifth journals 115*a* to 115*e*. FIG. 18 shows that the big end 63*b* of the control link 63 is connected to the first eccentric pin 113*a*, but a similar arrangement including a control link 63 provided on each of the remaining eccentric pins 113*b* to 113*d* is omitted from the drawing to avoid the crowding of the drawing.

Each journal 115*a* to 115*e* is rotatably supported by a bearing (not shown in the drawings) formed in the crankcase 4, and the third journal 115*c* which is centrally located in the control shaft 65 is provided with a driven gear 116 configured to be actuated by the hydraulic actuator AC.

The webs 117*a* and 117*b* interposing the first eccentric pin 113*a* and the webs 117*g* and 117*h* interposing the fourth eccentric pin 113*d* are formed in such a manner that the web connecting portions 118*a*, 118*b*, 118*c* and 118*d* extend in an opposite direction to the eccentric pins 113 with respect to the neutral central axial line of the control shaft 65. The inner surface of the crankcase 4 (not shown in the drawings) is provided with a pair of main body connecting members 119*a* and 119*g* which are each provided with a pair of connecting portions 120*a* and 120*b* or 120*g* and 120*h*.

Between each web connecting portion 118*a*, 118*b*, 118*g*, 118*h* and the corresponding main body connecting portion 120*a*, 120*b*, 120*g*, 120*h* is interposed a compression coil spring device 121*a*, 121*b*, 121*g*, 121*h*. Thus, four compression coil spring devices 121 are arranged symmetrically with respect to the central part of the control shaft 65, two of them on one axial side of the central part of the control shaft and the other two of then on the other axial side thereof. The web connecting portions 118*a*, 118*b*, 118*g*, 118*h* are configured that the pins 124*a*, 124*b*, 124*g*, 124*h* pivotally supporting the upper connecting pieces 122*a*, 122*b*, 122*g*, 122*h* are disposed coaxially with one another. Similarly, the main body connecting members 119*a* and 119*g* are disposed in such a manner that the pins 125*a*, 125*b*, 125*g*, 125*h* pivotally supporting the lower connecting pieces 123*a*, 123*b*, 123*g*, 123*h* are disposed coaxially with one another.

As shown in FIG. 19, each compression coil spring device 121 comprises an upper connecting piece 122 formed with a sleeve 128, a lower connecting piece 123 formed with a rod 129 and a pair of compression coil springs 126 and 127. The rod 129 is received by the sleeve 128 so as to be slidable relative to each other. The inner diameter of the compression coil spring 127 is greater than the outer diameter of the sleeve 128 so that the sleeve 128 can be received in the compression coil spring 127. The inner diameter of the compression coil spring 126 is greater than the outer diameter of the compression coil spring 127 so that the compression coil spring 127 can be received in the compression coil spring 126.

Each compression coil spring 127, 128 consists of a constant-pitch cylindrical coil spring, and the wire diameter and pitch of the compression coil spring 127 having a smaller coil diameter are both smaller than those of the compression coil spring 128 having a larger coil diameter. The coil ends of each compression coil spring consist of closed ends so that the ends coils may be supported evenly over their entire circumferences. Also, because the end turns are substantially perpendicular to the axial line, each compression coil spring 127, 128 sits in a stable manner, and does not readily buckle. So that the two mutually nested compression coil springs may not interfere with each other, the turns of the two compression coil springs 126 and 127 are reversed relative to each other.

The spring seat 138, 139 of each of the upper and lower connecting pieces 122 and 123 is provided with a pair of stepped seat surfaces which correspond to the different inner diameters of the two compression coil springs 127 and 128. The upper connecting piece 122 is U-shaped, and is provided with a pair of bifurcated ends 122A and 122B that interpose the web connecting portion 118 therebetween (see FIG. 18), and each bifurcated end 122A, 122B is provided with a hole 130*a*, 130*b* for receiving the pin 124. The upper end of each bifurcated end 122A, 122B is provided with an oil hole 132*a*, 132*b* for conducting engine oil to the sliding part of the pin 124, and an end surface of the upper connecting piece 122 flanked by the bifurcated ends 122A and 122B is also provided with an oil hole 142 which communicates with the interior of the sleeve 128 for conducting oil to a sliding interface between the sleeve 128 and rod 129. The lower connecting piece 123 is provided with a flat portion 123A which is configured to be interposed between the bifurcated ends of the corresponding main body connecting portion 120, and provided with a pin receiving hole 131 for receiving the pin 125.

As shown in FIG. 19, the rod 129 formed in each lower connecting piece 123 is received in the sleeve 128 formed in the corresponding upper connecting piece 122 so that the distance between the two pins 123 and 125 may be varied. The sleeve 128 has a substantially same length as the rod 129, and these two components are configured such that an adequate stroke for turning the control shaft 65 by a prescribed angle. The free end of the sleeve 128 is chamfered so that the sleeve 128 may not be caught by the coil wire of the inner compression coil spring 127 as it engages the inner compression coil spring 127. The profile of this section of the sleeve 128 may be tapered or curved as desired. The free end of the rod 129 of each lower connecting piece 123 is also chamfered.

By passing the pin 124 through a pin receiving hole 134 formed in the web connecting portion 118 and pin receiving holes 130*a* and 130*b* of the upper connecting piece 122, the upper connecting piece 122 is connected to the web connecting portion 118. The inner circumferential surface of each of the pin receiving holes 120*a* and 120*b* are formed with grooves, and the pin 124 is held in position by fitting C-clips 136*a* and 136*b* in these grooves. Similarly, by passing the pin 125 through pin receiving holes 135*a* and 135*b* formed in the main body connecting portion 120 and a pin receiving hole 131 of the lower connecting piece 123, the lower connecting piece 123 is connected to the main body connecting portion 120, and C-clips 137*a* and 137*b* are fitted in grooves formed in the pin receiving holes 135*a* and 135*b* on either outer axial side of the pin 125.

The oil holes 132*a* and 132*b* formed in the upper ends of the U-shaped bifurcated portions 122A and 122B of the upper connecting piece 122 as discussed earlier extend to the pin receiving holes 130*a* and 130*b* so that the engine oil splashed in the crankcase can be introduced to the sliding surface of the pin 124. The upper ends of the oil holes 132*a* and 132*b* are each countersunk so that the oil splashes may be effectively caught thereby. The positions of the oil holes 133*a* and 133*b* are determined so as not to overlap with the lower connecting piece 123 in plan view or are determined such as to avoid any obstacle to the capturing of the oil splashes to be located above the oil holes 132*a* and 132*b*. The upper end of the oil hole 142 is also countersunk.

The force acting on the control shaft 65 is described in the following with reference to FIG. 17. During the expansion stroke of the engine E, the piston 11 in the cylinder 5 is pushed down with an extremely strong force. The combustion pressure that the piston 11 receives is transmitted to the crankpin 30P via the upper link 61 and lower link 60, and turns the crankshaft 30. Because the center of the one end 60*a* of the lower link 60 is offset from the line connecting the center of the piston pin 13 with the center of the crankpin 30P, this force includes a component which turns the lower link 60 around the crankpin 30P or a component which pushes the other end 60*b* of the lower link 60 upward. Because the expansion stroke or combustion stroke occurs successively from one cylinder to another, the force that pulls up the control link 63 persists the whole time.

When the control shaft 65 is actuated under this condition, whereas a relatively small force is required to turn the control shaft 65 in clockwise direction and to thereby move the eccentric pin 113 upward, it requires a significant amount of force to turn the control shaft in counter clockwise direction and to thereby move the eccentric pin 113 downward because the force that pulls the control link 63 upward must be overcome.

However, because the compression coil spring device 121 is interposed between each web connecting portion 118 extending from the control shaft 65 and the corresponding main body connecting portion 120, the control shaft 65 is subjected to a bias torque that tends to turn the control shaft 65 in counter clockwise direction. Therefore, the maximum output that is required to angularly actuate the control shaft 65 can be minimized, and it becomes possible to use a relatively small actuator.

Because the compression coil spring device 121 can be installed on one side or below the control shaft 65 in the crankcase 4, the dimension of the engine E in the axial direction of the neutral axial line of the control shaft 65 is prevented from increasing. As it is possible to install a plurality of such devices, the size of each individual device can be minimized. Because the main body connecting members 119 are provided within the crankcase 4, the structure of the various connecting portions are prevented from becoming excessively complex.

Because the compression coil spring device 121 is connected to the web connecting portion 118 and main body connecting portion 120 via a link mechanism using pins 124 and 125, the line of action on the compression coil spring 121 can be kept fixed without causing the tilting and buckling of the compression coil springs 126 and 127 so that the required spring property can be obtained at all times. Through the use of the compression coil spring incorporated with a link mechanism as a biasing means for producing a biasing torque, hysteresis owing to tilting of the spring and frictions can be favorably controlled. Also, the freedom of design is enhanced so that the spring load and stroke can be changed at will, and a non-linear spring can be used. Therefore, the device can be easily configured to suit various types of engines.

As can be appreciated from FIG. 18, because the hydraulic actuator AC is provided on the third journal 115*c* which is located in an axially central part of the control shaft 65, and the compression coil spring devices 121 are arranged on either axial side of the hydraulic actuator AC in a symmetric manner, the twisting deformation of the control shaft 65 can be minimized, and the radial load acting on each of the journals 115*a* to 115*e* can be minimized. Also, by arranging the compression coil spring devices 121 in a symmetric manner with respect to the hydraulic actuator AC, the stress acting on the control shaft 65 can be distributed to the both axial sides of the hydraulic actuator AC evenly, and the overall load acting on the control shaft 65 can be minimized. Because each pair of compression coil spring devices 121 interpose the corresponding one of the eccentric pins 113 and hence the corresponding control link 63, the required rigidity of the related journals 115 can be minimized.

When a large torque is required to be produced by each compression coil spring device 121, it can be accomplished by extending the arm length of the web 117 measured from the center of the control shaft 65 to the web connecting portion 118, but as it requires the length of the spring to be increased so as to correspond to the increased stroke, it may impair the space efficiency due to a need to increase the size of the compression coil spring device 121. However, by coaxially nesting one of the compression coil springs 127 in the other compression coil spring 126, a greater torque can be applied to the control shaft 65. By combining a larger number of compression coil springs, more sophisticated torque properties may be given to the compression coil spring device 121. Such possibilities enhance the freedom in the design of the compression coil spring device 121.

As shown in FIGS. 17 and 20, by disposing the pins 124 and 125 on the common axial line of the compression coil springs 127 and 128, the point of action of the load is made to coincide with the line of the load bearing action of the compression coil springs 126 and 127. Thereby, as the sleeve 128 and rod 129 undergo a mutually sliding movement, the frictional force that can arise owing to the tilting of the compression coil springs 127 and 128 can be minimized.

Owing to the provision of the oil holes 132 and 133 for conducting engine oil to the sliding parts of the pins 124 and 125 as shown in FIG. 20, the pivoting movements of the compression coil spring devices 121 can be effected in a smooth manner. Because the upper end of each oil hole 132*a*, 132*b*, 133*a* and 133*b* is countersunk or dish-shaped, and the oil holes 133*a* and 133*b* provided in each main body connecting portion 120 are disposed so as not to align with the lower connecting pieces 123 in plan view, the splashed engine oil in the crankcase 4 can be effectively captured and this promotes a favorable lubrication. Therefore, each compression coil spring 126 and 127 is able to provide a designed loading action, and a torque of a precise magnitude can be applied to the control shaft 65. Also, these oil holes 132*a*, 132*b*, 133*a* and 133*b* contribute to the reduction in the weights of the related component parts.

The oil hole 142 formed in each upper connecting piece 122 in communication with the interior of the sleeve 128 supplies lubricating oil to the sliding part between the sleeve 128 and the rod 129 received therein so that the control shaft 65 can be actuated in an even more favorable manner and the weight of the upper connecting piece 122 can be reduced. The oil hole 142 also functions as an air hole for venting and admitting air out of and into the interior of the sleeve 128 when the rod 129 moves out of and into the interior of the sleeve 128, respectively, and this also contributes to a smooth sliding movement between the sleeve 128 and rod 129.

The hydraulic actuator AC is connected to the central part of the control shaft 65, but may also be connected one end or each end of the control shaft 65 or any other intermediate part of the control shaft 65. The biasing means of the illustrated embodiment consisted of compression coil springs, but may also consist of tension springs, air springs or hydraulic cylinders. The illustrated embodiment used four compression coil spring devices 121, but may also use one or two of such compression coil spring devices 121. The number of the compression coil spring devices may be even numbers such as six and eight but may also be odd numbers such as five and seven. The layout of the compression coil spring devices may not be necessarily symmetric with respect to the center of the control shaft, and the main body connecting members 19 may not be necessarily mounted on the inner surface of the crankcase 4 but may also be mounted in any other part of the engine main body.

Each device serving as the biasing means used a pair of compression coil springs in the foregoing embodiment, but may also use one, three or more compression coil springs. Each compression coil spring may not be a constant-pitch cylindrical coil spring but may consist of an uneven-pitch coil spring, a conical spring, an hourglass-shaped coil spring or a barrel-shaped spring. A taper coil spring using a tapering coil wire or other coil springs using coil wires of various cross sections such as rectangular, elliptic or oval shapes or combinations of such springs may also be used. For instance, by using an uneven-pitch coil spring, a nonlinear loading property may be realized.

The pins 124 and 125 are not necessarily required to be on the common axial line of the compression coil springs 126 and 127, by may also be offset from the common axial line of the compression coil springs 126 and 127. By using such an arrangement, an extension of the rod 129 may be allowed to pass entirely through the upper connecting piece 122 so that the rod 129 may extend beyond the part received in the sleeve 128.

In the foregoing embodiment, because the connecting portions are formed in the outer wall of the engine block, and the biasing means connected therefore constantly applies a large force to the outer wall of the engine block, the rigidity of the connecting portions must be increased in a corresponding manner, and this may require the thickness of the engine block outer wall may have to be increased. This may necessitate an increase in the weight of the engine main body. The embodiments illustrated in FIGS. 21 to 25 eliminate such a problem.

The engine E given as a fourth embodiment of the present invention and illustrated in FIG. 21 consists of an in-line four-cylinder engine, and a vertical sectional view of one of the cylinders is shown in FIG. 21. A crankcase 4 is formed by joining a cylinder block 4*a* and a bearing block 4*b* with each other, and an oil pan 10 is attached to the bottom end of the crankcase 4 to receive oil that is plashed in the crankcase 4. A piston 11 is slidably received in the cylinder 5 formed in an upper part of the cylinder block 4*a*, and is connected to a crankshaft 30 via an upper link 61 and a lower link 60.

The crankshaft 30 is essentially no different from that of a conventional fixed compression ratio engine, and comprises a crank journal 30J (rotational center of the crankshaft) supported by a crankcase (engine main body) 4 and a crankpin 30P radially offset from the crank journal 30J. An intermediate point of the lower link 60 is supported by the crankpin 30P so as to be able to tilt like a seesaw. An end 60*a* of the lower link 60 is connected to a big end 61*b* of the upper link 61, and a small end 61*a* of the upper link 61 is connected to a piston pin 13.

The other end 60*b* of the lower link 60 is connected to a small end 63*a* of a control link 63 which is similar in structure to a connecting rod that connects a piston with a crankshaft in a normal engine. A big end 63*b* of the control link 63 is connected to an eccentric portion 113 of an control shaft 65, which is rotatably supported by the bearing block 4*b* and a shaft holder 151 attached to the bearing block 4*b*, via a bearing bore formed by using a bearing cap 63*c*.

As shown in FIGS. 21 and 22, the shaft holder 151 is provided with four support walls 152*a*, 152*b*, 152*c* and 152*d* supporting the journals 115 of the control shaft 65 and a connecting base portion 153 connecting these support walls one another. Each support wall 152 is formed with a pair of mounting holes 154, and the shaft holder 151 can be fixed to the bearing block 4*b* by passing threaded bolts 155 through these mounting holes 154 and threading into threaded holes formed in the bearing block 4*b*.

In a middle part of the control shaft 65 is formed a driven gear 116, and a vane-type hydraulic actuator AC for angularly actuating the control shaft 65 is formed with a drive gear 141 that meshes with the driven gear 116 (see FIG. 22). Thereby, the angular position of the control shaft 65 can be continuously controlled and held at a desired angle according to the operating condition of the engine E. A journal portion provided inside the hydraulic actuator AC is provided with a plurality of vanes projecting radially from the outer periphery thereof, and an oil chamber is defined by the housing for each vane. Each oil chamber is divided into a first oil chamber and a second oil chamber by the corresponding vane so that the rotor may be angularly actuated and retained at a desired position by appropriately supplying and expelling the hydraulic oil into and from these oil chambers. The hydraulic circuits described in connection with FIGS. 6*a* and 6*b* are equally applicable to this embodiment, and the same description applies to this embodiment.

In this engine E, by rotatively actuating the control shaft 65, the position of the big end 63*b* of the control link 63 can be moved from the position illustrated in FIG. 21 in either vertical direction with respect to the neutral axial line of the control shaft 63, and this causes a corresponding change in the swinging angle of the lower link 60 in response to the rotation of the crankshaft 30. Thereby, in response to the change in the swinging angle of the lower link 60, the stroke of the piston in the cylinder 5 or the top dead center and bottom dead center positions of the piston 11 change. Thus provided is a function to vary at least one of the compression ratio and displacement of the engine in a continuous manner.

The control shaft 65 is provided with webs 117, and a web connecting portion 118 (first connecting portion) is formed on an end of each of the webs 117 opposite to the corresponding eccentric pin 13 with respect to the neutral axial line of the control shaft 65. A plurality of main body connecting members 119 each formed with a pair of main body connecting portions 120 (second connecting portion) are attached to the inner surface of the crankcase 4. A compression coil spring device (biasing means) 121 is interposed between each main body connecting portion 120 and the corresponding web connecting portion 118.

Each compression coil spring device 121 is provided with an upper connecting piece (first connecting piece) 122 at an upper then thereof and a lower connecting piece (second connecting piece) 123 at a lower end thereof, each of these connecting pieces are pivotally connected to the corresponding web connecting portion 118 and main body connecting portion 120 via pins (first and second pins) 124 and 125, respectively. Between the upper connecting piece 122 and the lower connecting piece 123 are interposed a pair compression coil springs 126 and 127 that are coaxially nested with each other. The pins 124 and 125 are disposed on the axial line of the compression coil springs 126 and 127.

As shown in FIG. 22, the control shaft 65 includes a first journal 115*a*, a second journal 115*b*, a third journal 115*c*, a fourth journal 115*d* and a fifth journal 115*e* that are arranged from the one end to the other end of the control shaft 65 in this order. Between each adjacent pair of the journals 115 is disposed an eccentric pin 113 and a pair of webs 117 flanking the eccentric pin 113. Thus, a first eccentric pin 113*a* is interposed between the first and second journals 115*a* and 115*b*, a second eccentric pin 113*b* is interposed between the second and third journals 115*b* and 115*c*, and so on. Thus, four eccentric pins 113*a* to 113*d* are provided on a same axial line so as to alternate with the five journals 115.

Each journal 115 is connected to the adjacent eccentric pins 113 via the corresponding webs 117. For instance, the web 117*a* is interposed between the first journal 115*a* and the first eccentric pin 113*a*. Similarly, eight webs 117*a* to 117*h* are arranged so as to correspond to the first to fifth journals 115*a* to 115*e*. FIG. 22 shows that the big end 63*b* of the control link 63 is connected to the first eccentric pin 113*a*, but a similar arrangement including a control link 63 provided on each of the remaining eccentric pins 113*b* to 113*d* is omitted from the drawing to avoid the crowding of the drawing.

Each journal 115*a* to 115*e* is rotatably supported by a bearing (not shown in the drawings) formed in the crankcase 4, and the third journal 115*c* which is centrally located in the control shaft 65 is provided with a driven gear 116 configured to be actuated by the hydraulic actuator AC.

The webs 117*a* and 117*b* interposing the first eccentric pin 113*a* and the webs 117*g* and 117*h* interposing the fourth eccentric pin 113*d* are formed in such a manner that the web connecting portions 118*a*, 118*b*, 118*c* and 118*d* extend in an opposite direction to the eccentric pins 113 with respect to the neutral central axial line of the control shaft 65. A pair of main body connecting members 119*a* and 119*g* are attached to the lower surface of the shaft holder 151, and each main body connecting member is provided with a pair of main body connecting portions 120*a*, 120*b*, 120*g*, 120*h*.

Between each web connecting portion 118*a*, 118*b*, 118*g*, 118*h* and the corresponding main body connecting portion 120*a*, 120*b*, 120*g*, 120*h* is interposed a compression coil spring device 121*a*, 121*b*, 121*g*, 121*h*. Thus, four compression coil spring devices 121 are arranged symmetrically with respect to the central part of the control shaft 65, two of them on one axial side of the central part of the control shaft and the other two of then on the other axial side thereof. The web connecting portions 118*a*, 118*b*, 118*g*, 118*h* are configured that the pins 124*a*, 124*b*, 124*g*, 124*h* pivotally supporting the upper connecting pieces 122*a*, 122*b*, 122*g*, 122*h* are disposed coaxially with one another. Similarly, the main body connecting members 119*a* and 119*g* are disposed in such a manner that the pins 125*a*, 125*b*, 125*g*, 125*h* pivotally supporting the lower connecting pieces 123*a*, 123*b*, 123*g*, 123*h* are disposed coaxially with one another. The compression coil spring devices 121 are not different from that illustrated in FIGS. 19 and 20 and reference should be made to the related description.

The force acting on the control shaft 65 is described in the following with reference to FIG. 21. During the expansion stroke of the engine E, the piston 11 in the cylinder 5 is pushed down with an extremely strong force. The combustion pressure that the piston 11 receives is transmitted to the crankpin 30P via the upper link 61 and lower link 60, and turns the crankshaft 30. Because the center of the one end 60*a* of the lower link 60 is offset from the line connecting the center of the piston pin 13 with the center of the crankpin 30P, this force includes a component which turns the lower link 60 around the crankpin 30P or a component which pushes the other end 60*b* of the lower link 60 upward. Because the expansion stroke or combustion stroke occurs successively from one cylinder to another, the force that pulls up the control link 63 persists the whole time.

When the control shaft 65 is actuated under this condition, whereas a relatively small force is required to turn the control shaft 65 in clockwise direction and to thereby move the eccentric pin 113 upward, it requires a significant amount of force to turn the control shaft in counter clockwise direction and to thereby move the eccentric pin 113 downward because the force that pulls the control link 63 upward must be overcome.

However, because the compression coil spring device 121 is interposed between each web connecting portion 118 extending from the control shaft 65 and the corresponding main body connecting portion 120, the control shaft 65 is subjected to a bias torque that tends to turn the control shaft 65 in counter clockwise direction. Therefore, the maximum output that is required to angularly actuate the control shaft 65 can be minimized, and it becomes possible to use a relatively small actuator.

Because the compression coil spring device 121 can be installed on one side or below the control shaft 65 in the crankcase 4, the dimension of the engine E in the axial direction of the neutral axial line of the control shaft 65 is prevented from increasing. As it is possible to install a plurality of such devices, the size of each individual device can be minimized. Because the main body connecting members 119 are provided within the crankcase 4, the structure of the various connecting portions are prevented from becoming excessively complex.

Because the compression coil spring device 121 is connected to the web connecting portion 118 and main body connecting portion 120 via a link mechanism using pins 124 and 125, the line of action on the compression coil spring 121 can be kept fixed without causing the tilting and buckling of the compression coil springs 126 and 127 so that the required spring property can be obtained at all times. Through the use of the compression coil spring incorporated with a link mechanism as a biasing means for producing a biasing torque, hysteresis owing to tilting of the spring and frictions can be favorably controlled. Also, the freedom of design is enhanced so that the spring load and stroke can be changed at will, and a non-linear spring can be used. Therefore, the device can be easily configured to suit various types of engines.

The main body connecting portions 119 are attached to the shaft holder 151 which has a high rigidity for supporting the control shaft 65 by using threaded bolts 156 so that the increase in the weight of the engine E can be avoided as opposed to the case where the oil pan 10 is reinforced by increasing the thickness thereof and the main body connecting portions 119 are attached to the oil pan 10 although the oil pan 10 is otherwise not required to have any significant rigidity. Dedicated threaded bolts 156 are used for securing the main body connecting members 119 to the shaft holder 151 in the illustrated embodiment, but it is also possible to commonly use the threaded bolts 155 for securing the shaft holder 151 also for securing the main body connecting members 119 to the shaft holder 151. More specifically, each mounting hole for securing the main body connecting members 119 may be aligned with one of the mounting holes 154 of the shaft holder 151 so that both the main body connecting members 119 and the shaft holder 151 may be secured by using common threaded bolts 155. Thereby, the number of component parts can be reduced, the assembly work can be simplified, and the increase in the weight of the engine E can be minimized. Also, the pins 124 and 125 are not necessarily required to be disposed on the common axial line of the compression coil springs 126 and 127, and may be offset from this common axial line.

FIGS. 23 and 24 show a modified embodiment of the compression coil spring device. As shown in these drawings, the compression coil spring device 161 comprises an upper connecting piece 162 fitted with a sleeve 167, a lower connecting piece 163 fitted with a rod 168, a pair of compression coil springs 165 and 166 disposed in tandem, and a retainer 164 interposed between the two compression coil springs 165 and 166. The retainer 164 comprises a flange 169 and a sleeve 170 and a rod 171 extending centrally from either side of the flange 169. It is configured such that the rod 171 is received in the sleeve 167 of the upper connecting piece 162, and the sleeve 170 receives the rod 168 of the lower connecting piece 163, in a slidable manner in each case. The two compression coil springs 165 and 166 have a substantially same outer diameter and have constant coil pitches, and are interposed between the retainer 164 and lower connecting piece 163 and between the retainer 164 and upper connecting piece 162, respectively. The two compression coil springs 165 and 166 have a substantially same length in the illustrated embodiment, but may also have different lengths depending on the particular desired spring property.

One of the compression coil springs 165 has a greater coil wire diameter and a greater coil pitch than the other compression coil spring 166, and hence have a fewer effective turns and a higher spring constant than the other. The spring support surfaces of the upper connecting piece 162, lower connecting piece 163 and retainer 164 are each provided with a stepped spring seat 176-179 that corresponds to the inner diameter of the corresponding compression coil spring. The compression coil springs 165 are 166 are thus disposed in a coaxial relationship with the spring ends retained by these stepped spring seats 176-179.

The upper connecting piece 162 is formed with an oil hole 182 communicating with the interior of the sleeve 167, and an axial center of the rod 171 of the retainer 164 is formed with an oil hole 175 communicating with the interior of the sleeve 170 via the interior of the flange 169. The length of the rod 171 is greater than the depth of the sleeve 167 so that the tip of the rod 171 abuts the bottom of the sleeve 167 before the compression coil spring 166 deflects more than the tolerable stress of the spring 166 permits.

By thus combining a plurality of compression coil springs 165 and 166 having different spring constants in a serial connection, spring properties that can change over a wide range can be achieved, and it becomes easier to ensure an adequate stroke and load that are required to turn the control shaft by a prescribed angle. More specifically, when a single uneven-pitch spring is used for the purpose of obtaining a non-linear spring constant, the use of a coil wire having an increased diameter to ensure the maximum load prevents a desired stroke to be obtained. If the number of turns of the coil increased to ensure a required stroke, the size of the compression coil spring increases. If the wire diameter is reduced, a required stroke may be ensured without increasing the size of the device, but an adequate large spring load cannot be obtained. However, by combining a plurality of compression coil springs 165 and 166 having different spring constants in a serial connection, it becomes possible to obtain a required stroke and an adequate spring load at the same time.

Owing to the oil holes 175 and 182, the engine oil introduced into the sleeve 167 via the oil hole 182 of the upper connecting piece 122 lubricates the sliding engagement between the sleeve 167 and rod 171, and further reaches the interior of the sleeve 170 via the oil hole 175 to lubricate the sliding engagement between the sleeve 170 and rod 168 as well. Thereby, the control shaft 65 can be actuated in a smooth manner. Furthermore, because the oil hole 182 functions as an air hole for the interior of the sleeve 167 and the oil hole 175 functions as an air hole for the interior of the sleeve 170, the control shaft 65 can be actuated in an even more smooth manner.

Another modified embodiment of the fourth embodiment of the present invention is described in the following with reference to FIG. 25. In this case, the shaft holder 181 is formed integrally, and comprises four support walls 182 for supporting the journals 115 of the control shaft 65, a connecting base portion 183 connecting these support walls 182 one another and four projections 184 extending laterally from the lower surface of the connecting base portion 183. The free end of each projection 184 forms a main body connecting portion 185. Each support wall 182 is formed with a pair of mounting holes which are also passed through the main body connecting portion 185, and the shaft holder 151 is secured to the bearing block **4*b* by passing threaded bolts 155 through these mounting holes and threading into corresponding threaded holes formed in the bearing block 4*b***.

The compression coil spring device 121 is provided with an upper connecting piece 122 in an upper end thereof and a lower connecting piece 123 in a lower end thereof, and these connecting pieces 122 and 123 are connected to the web connecting portion 118 and main body connecting portion 185, respectively, by using pins 124 and 125. Between the upper connecting piece 122 and lower connecting piece 123 are interposed a pair of compression coil springs 126 and 127 which are nested with each other in a coaxial relationship. The pins 124 and 125 are disposed on the common axial line of the compression coil springs 126 and 127.

By thus forming the main body connecting portion 185 integrally with the shaft holder 151, the number of component parts is reduced, the assembly work is simplified, and the weight of the engine can be minimized.

This concludes the description of the preferred embodiment, but the present invention is not limited by the foregoing embodiment. For instance, although the illustrated embodiment was directed to an in-line four-cylinder engine, the present invention is equally applicable to parallel engines, V-engines, six-cylinder engines and eight-cylinder engines. The control shafts of the illustrated embodiment consisted of control shafts but may also consist of other control members such as those linearly actuated by hydraulic cylinders or the like as long as they can displace the pivot points of the control links 63.

The contents of the original Japanese patent application on which the Paris Convention priority claim is made for the present application as well as the contents of the prior art references mentioned in this application are incorporated in this application by reference.

Although the present invention has been described in terms of preferred embodiments thereof, it is obvious to a person skilled in the art that various alterations and modifications are possible without departing from the scope of the present invention which is set forth in the appended claims.

Figure 1:
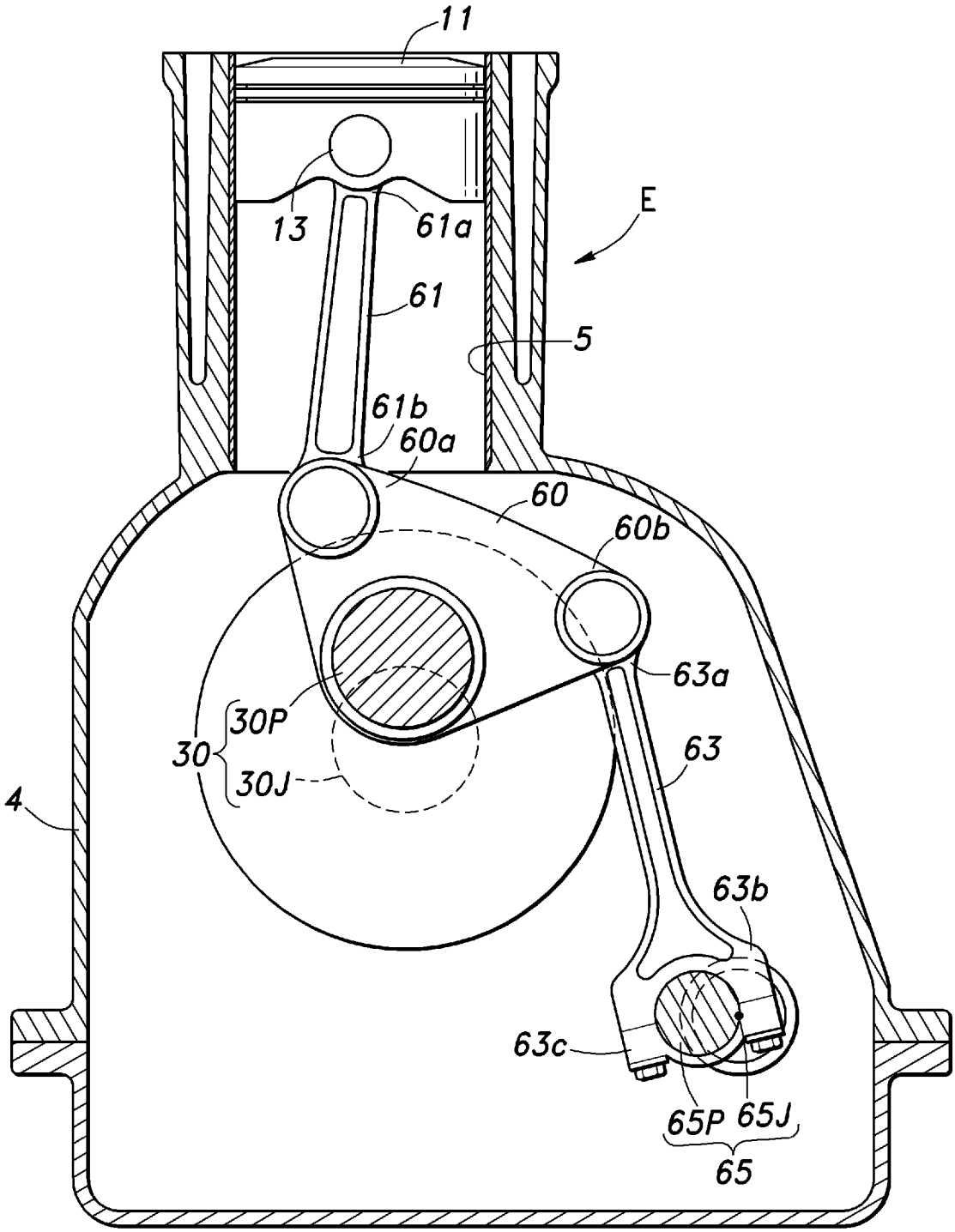
FIG. 1 is a vertical sectional view of the internal combustion engine given as a first embodiment of the present invention under the low compression ratio condition of the engine when the piston is at the top dead center.
Figure 2:
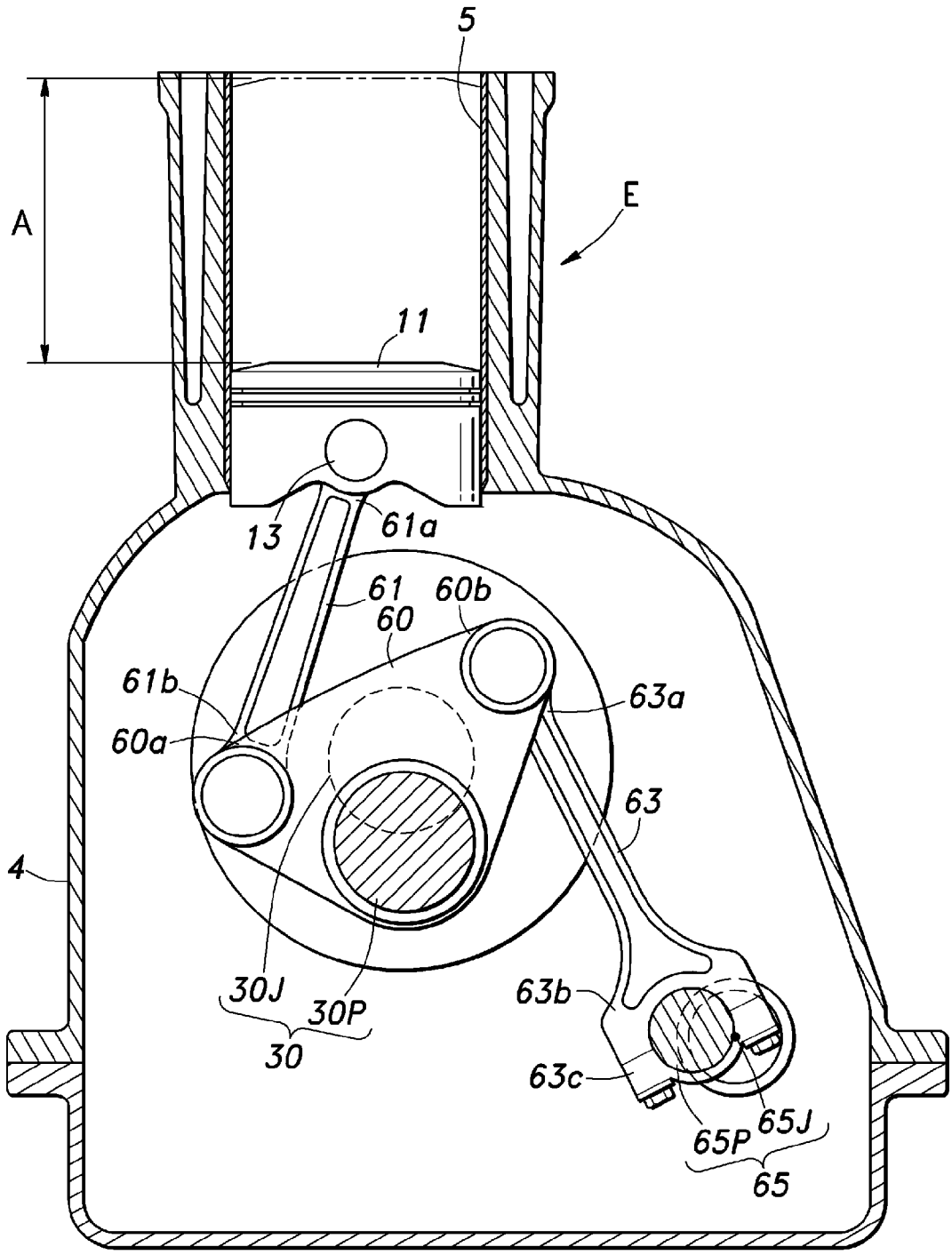
FIG. 2 is a vertical sectional view of the internal combustion engine under the low compression ratio condition of the engine when the piston is at the bottom dead center.
Figure 3:
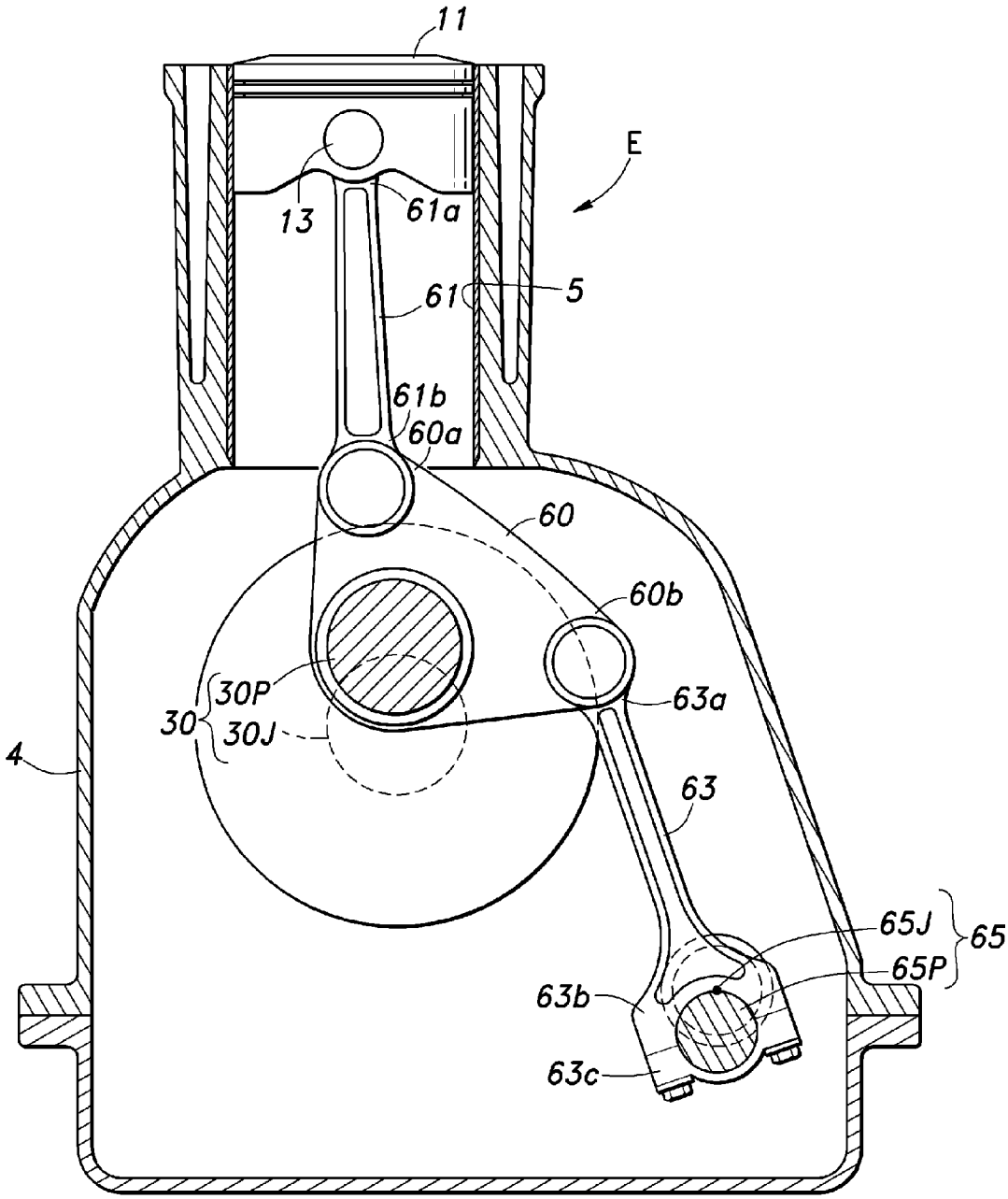
FIG. 3 is a vertical sectional view of the internal combustion engine under the high compression ratio condition when the piston is at the top dead center.
Figure 4:
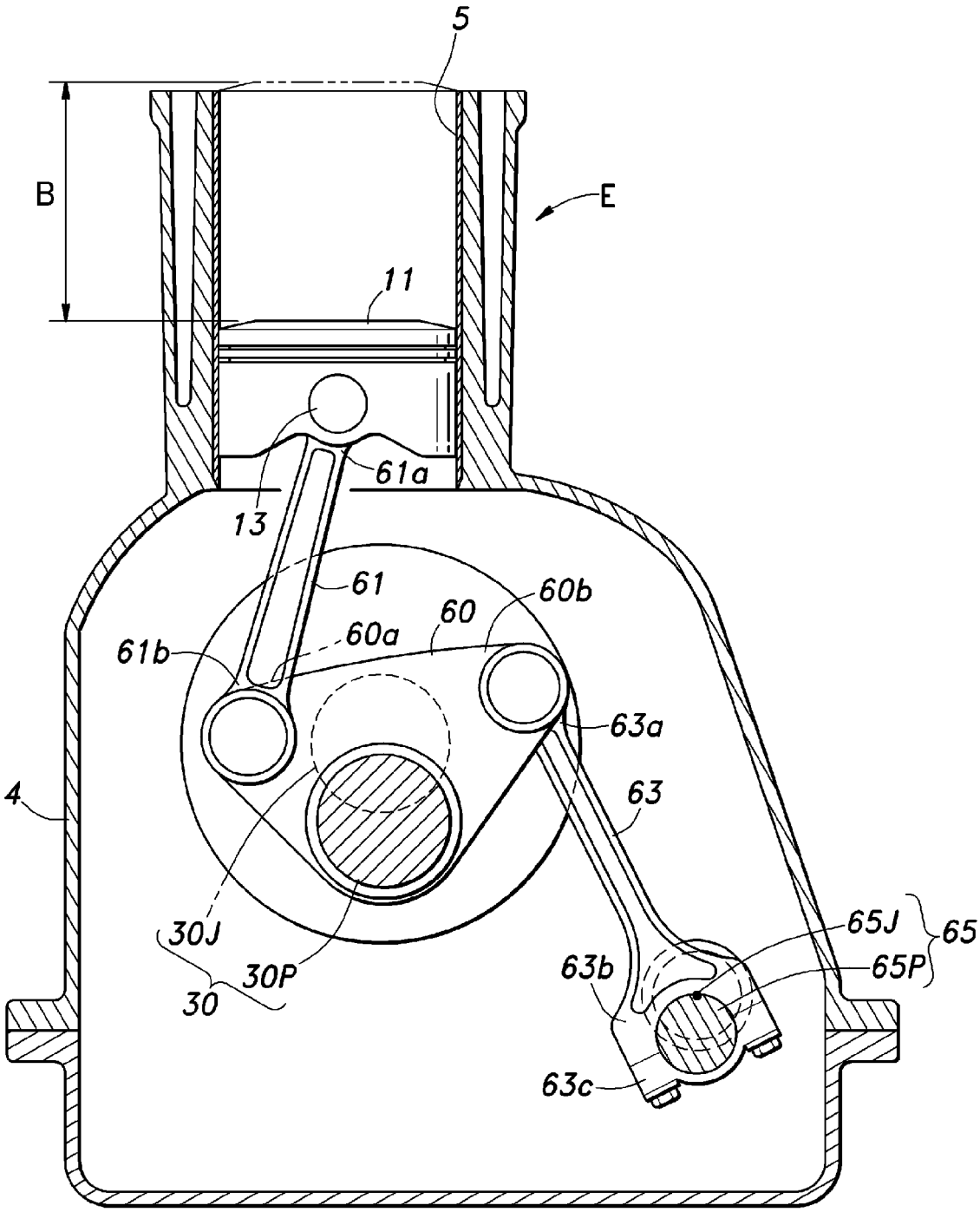
FIG. 4 is a vertical sectional view of the internal combustion engine under the high compression ratio condition when the piston is at the bottom dead center.
Figure 5:
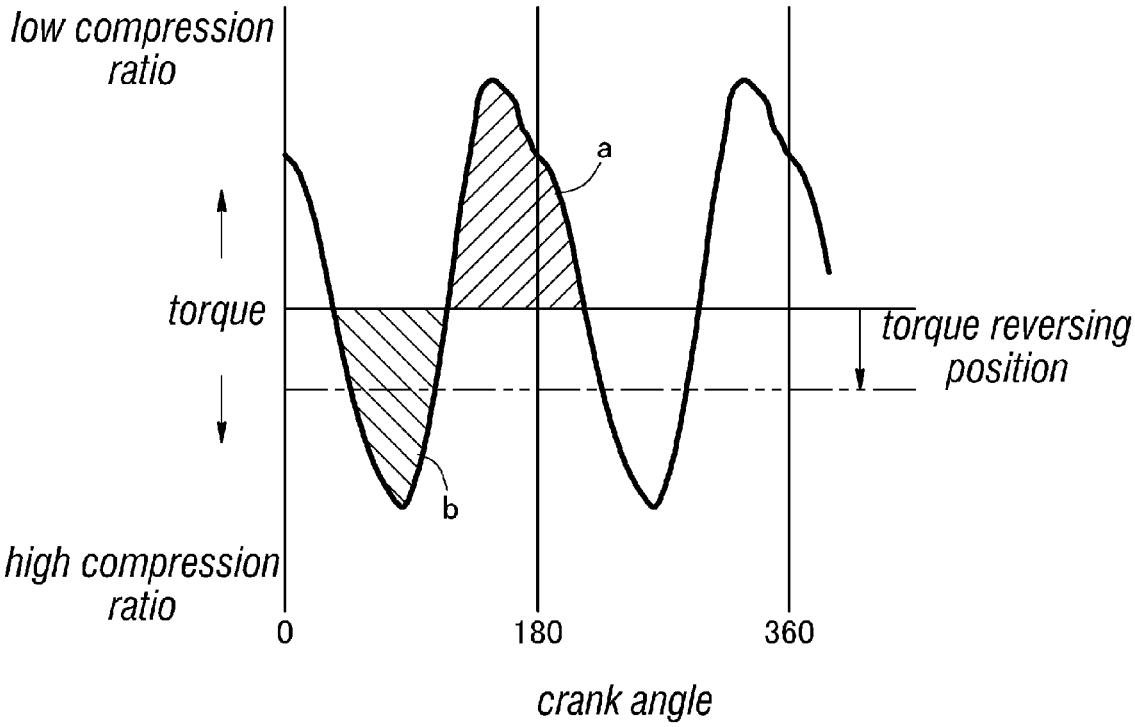
FIG. 5 is a graph showing the changes in the torque which is applied to the control shaft.
Figure 7:
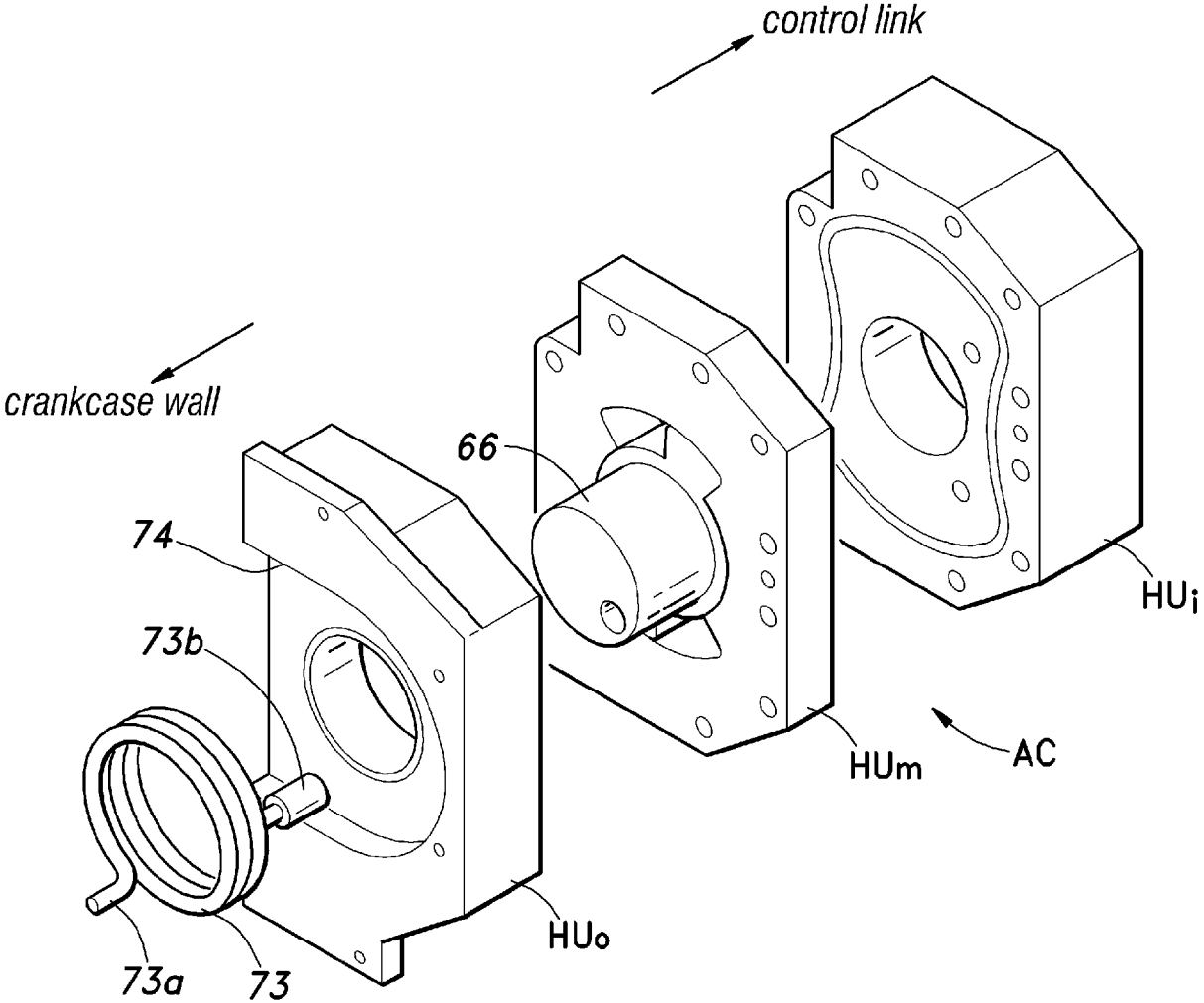
Figure 8:
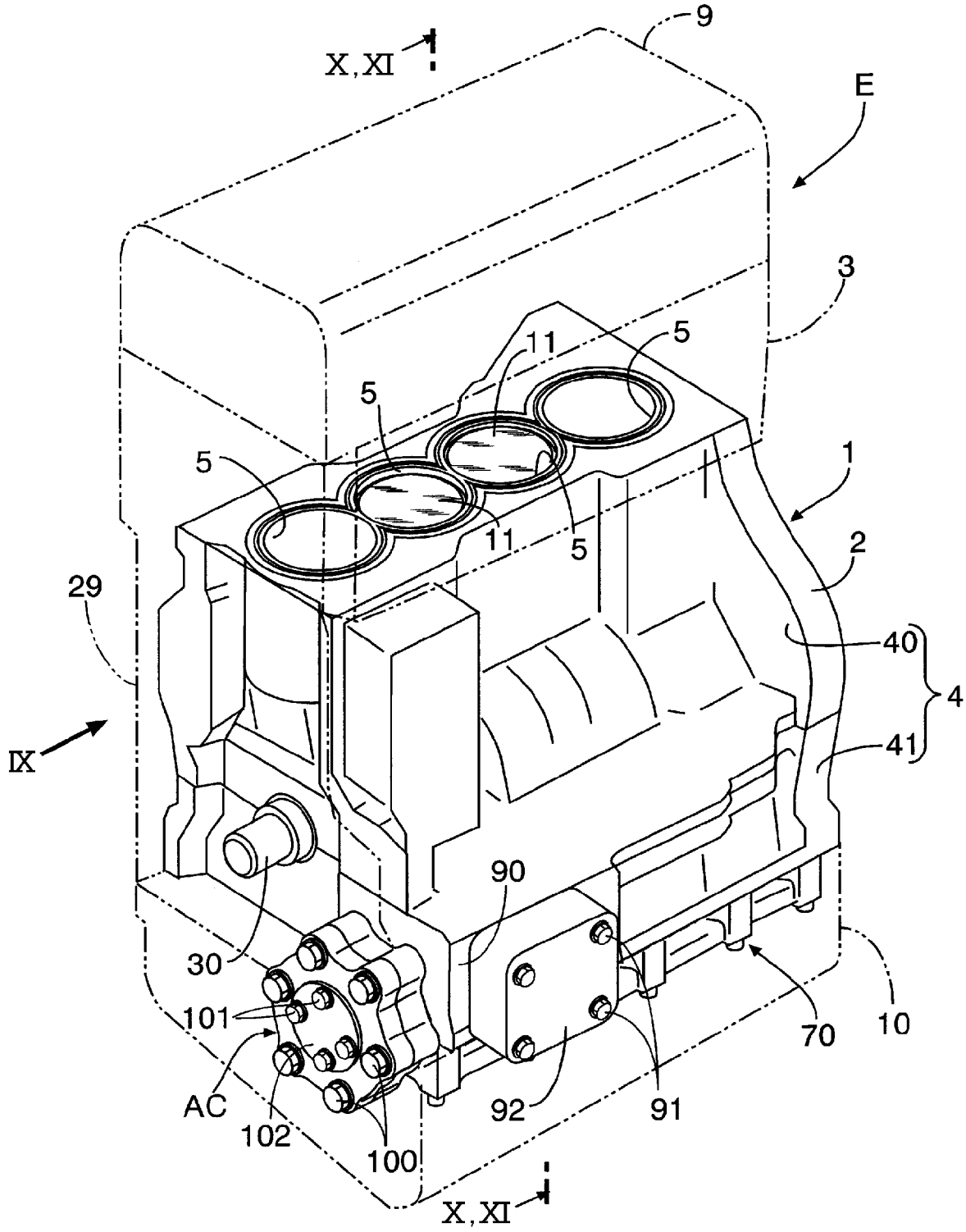
Figure 9:
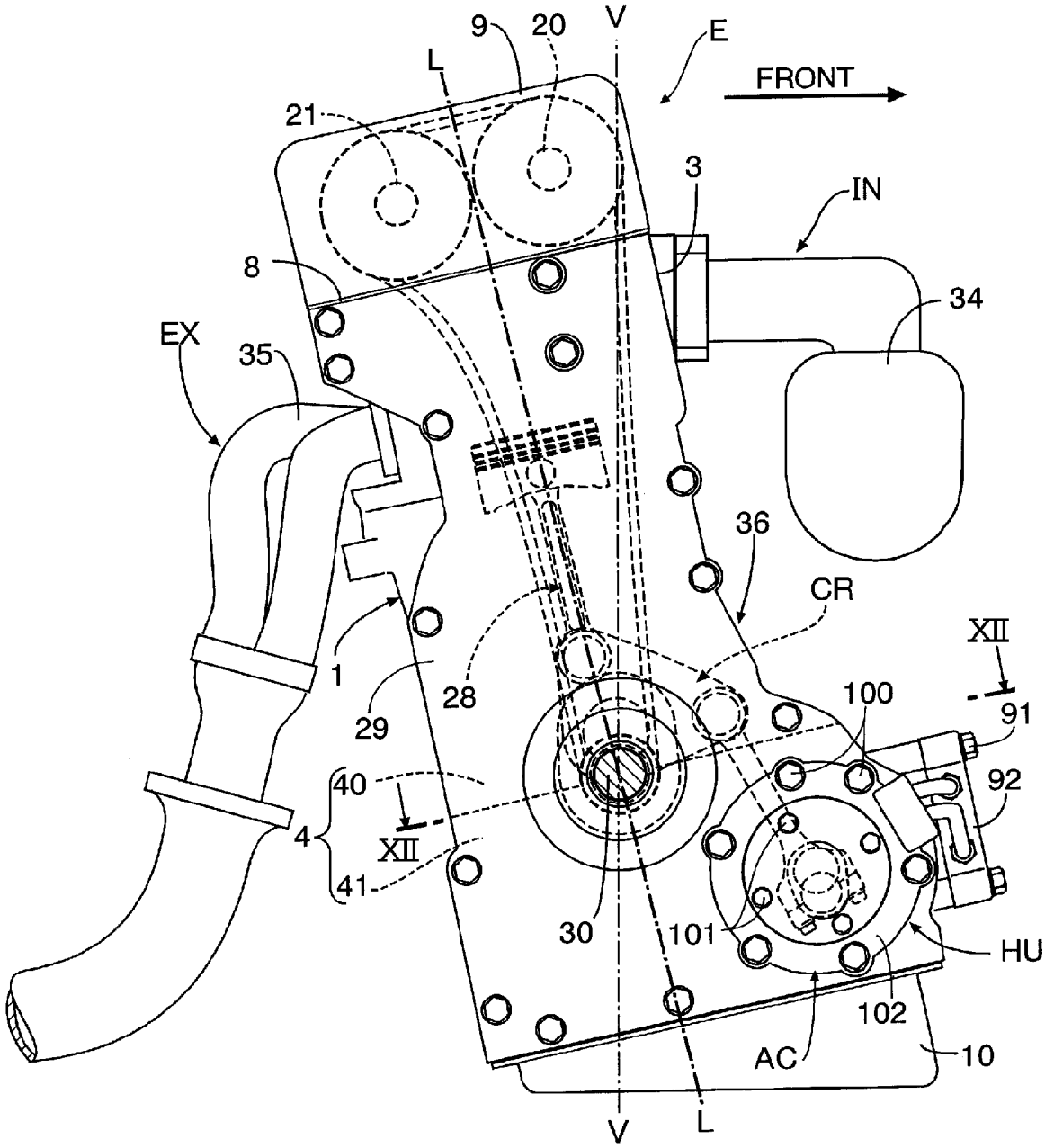
Figure 10:
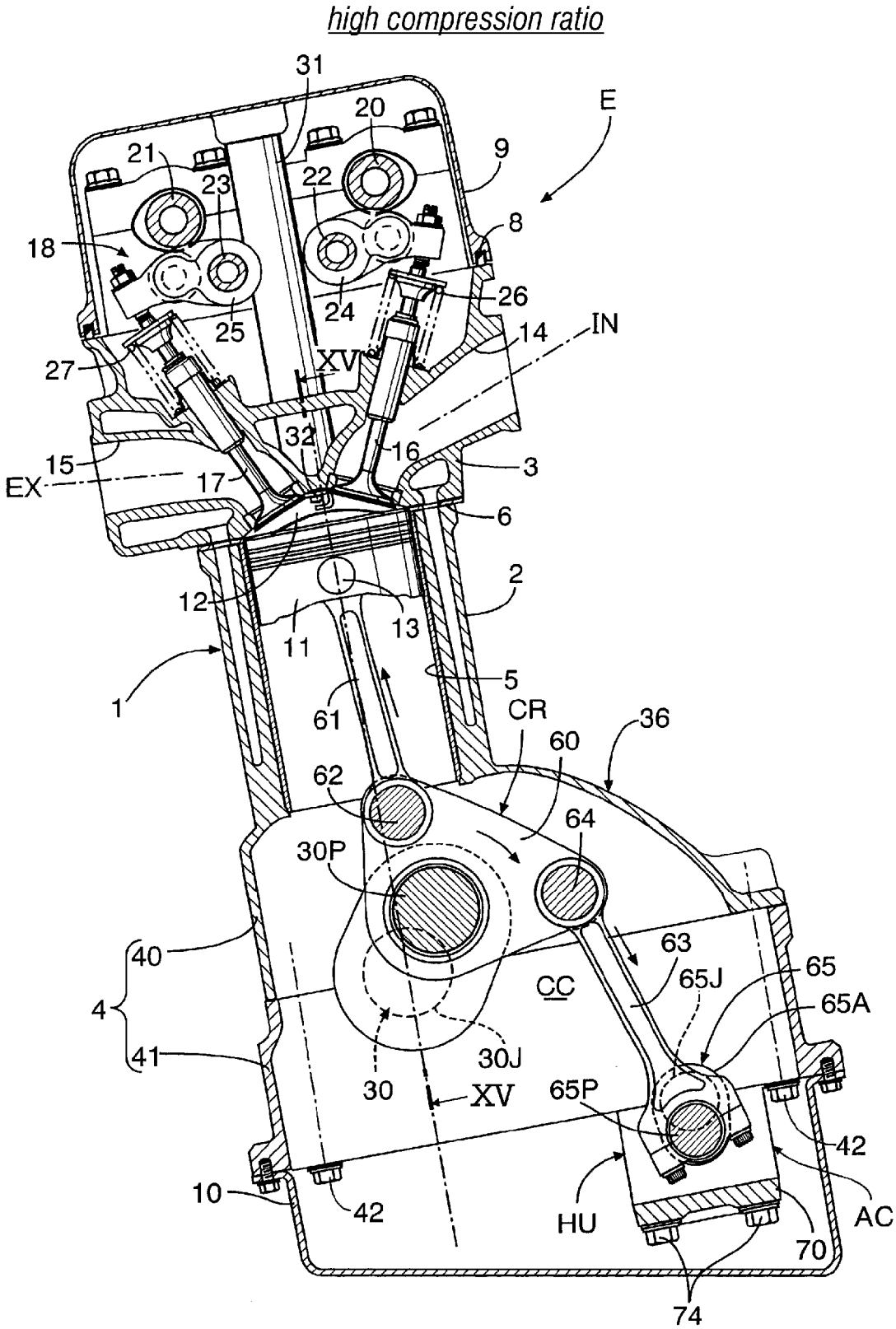
Figure 11:
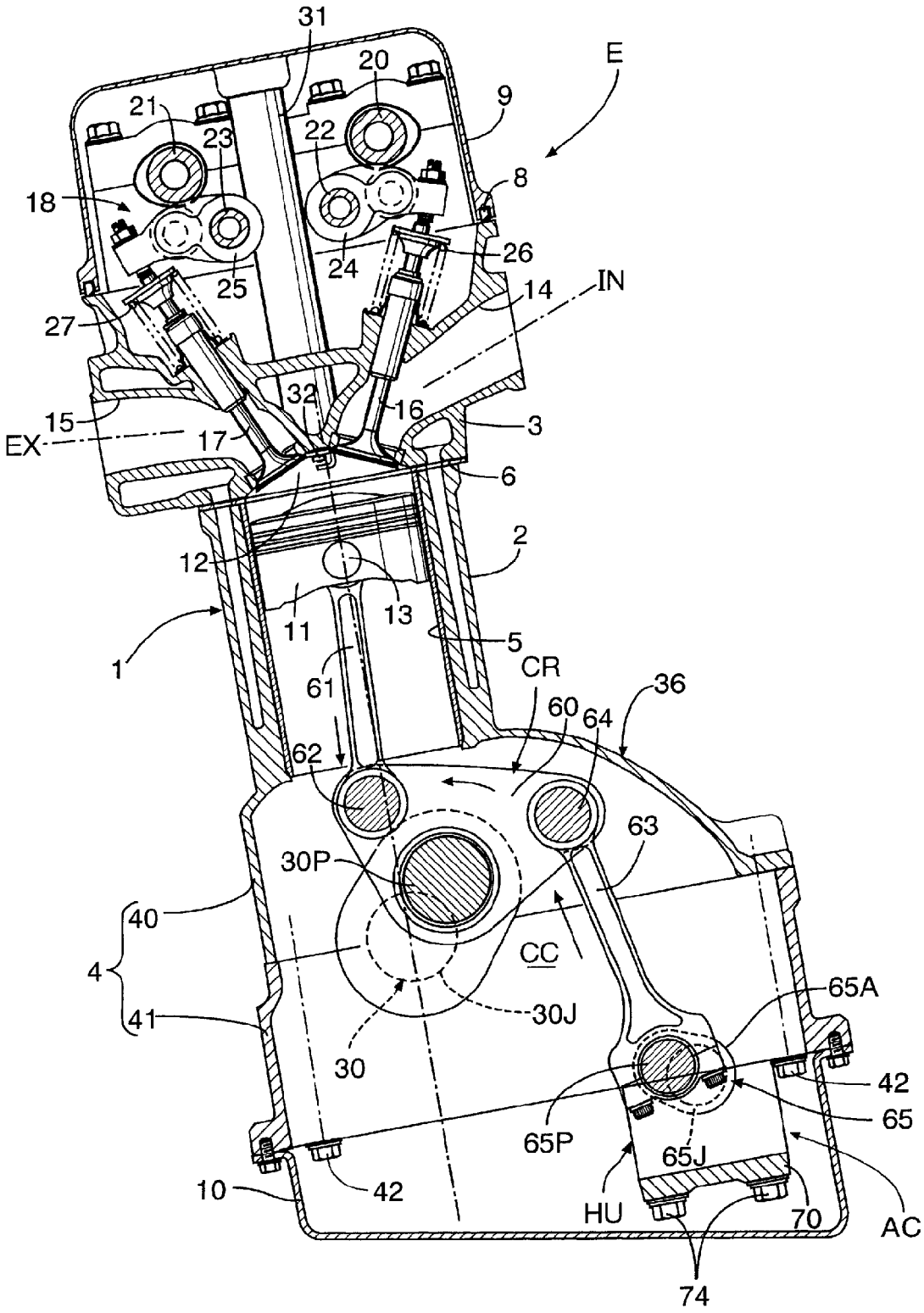
Figure 12:
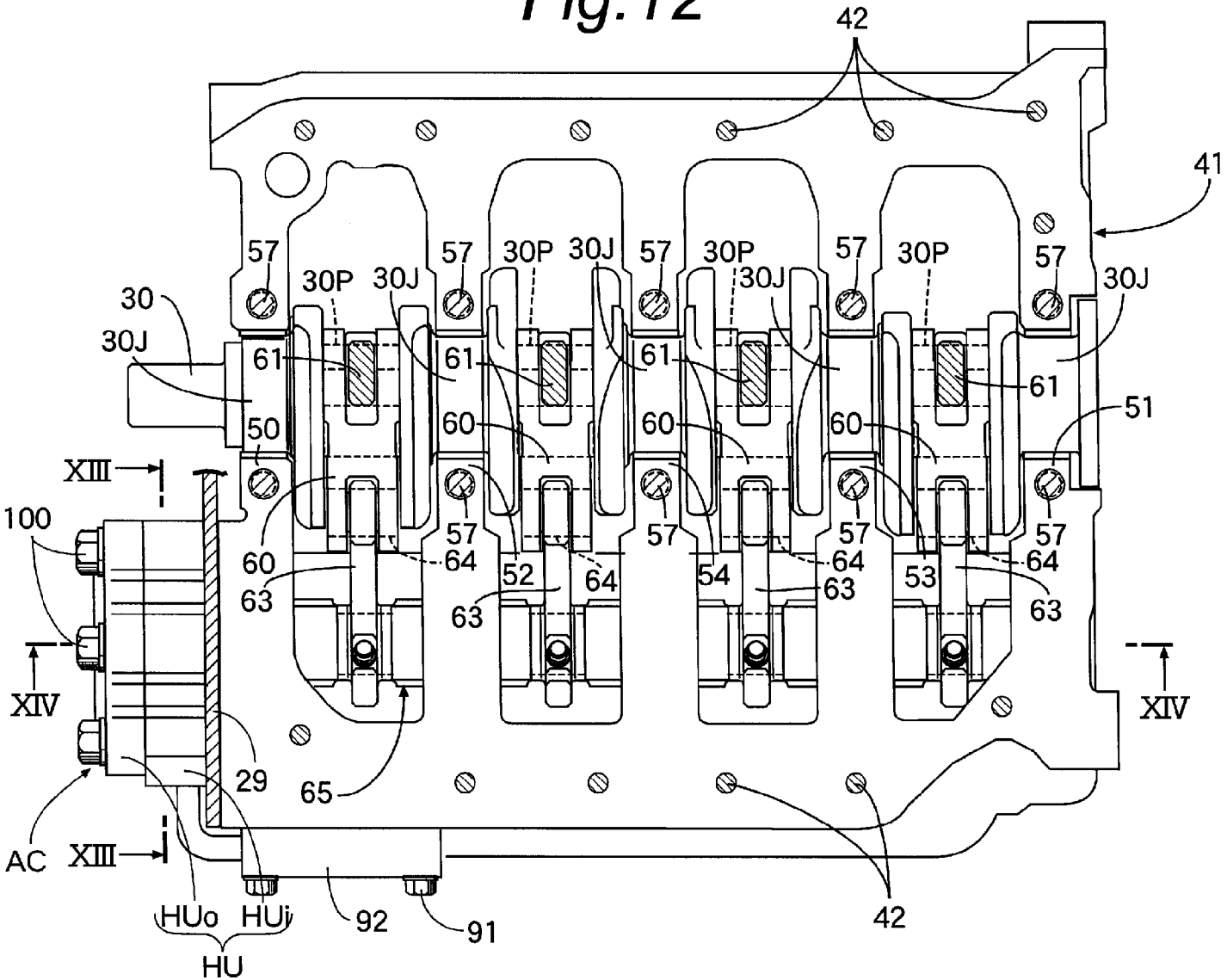
Figure 13:
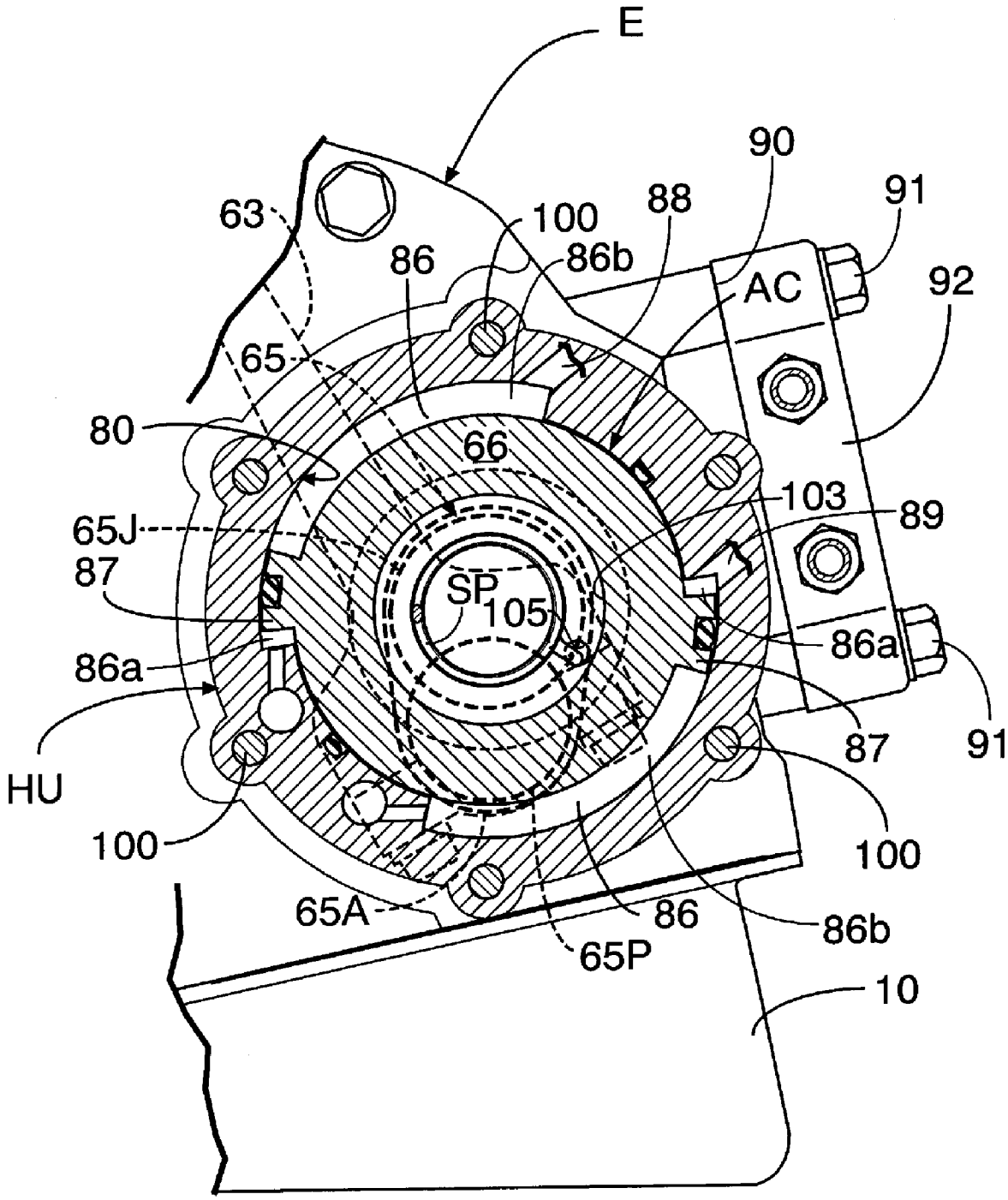
Figure 14:
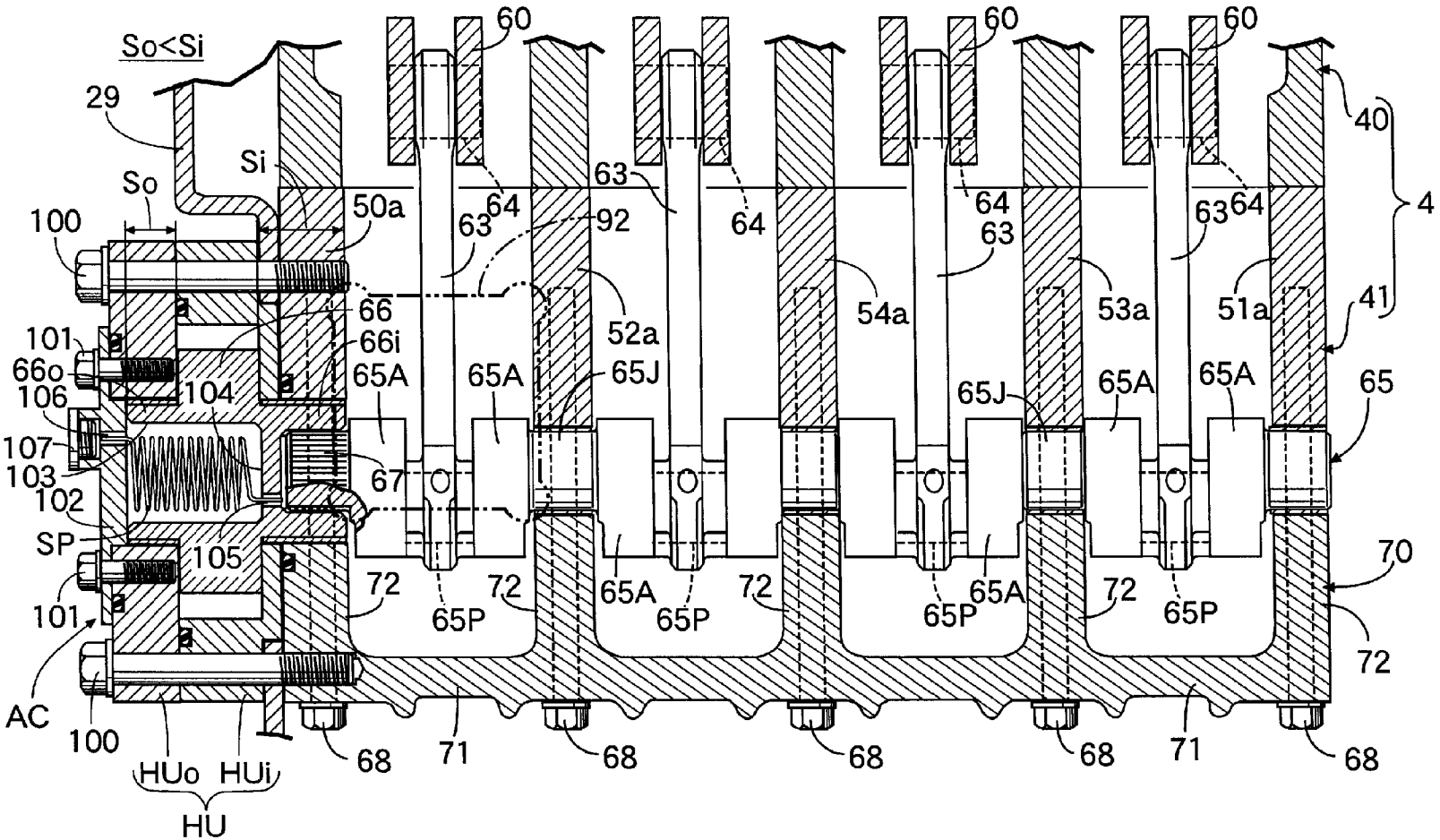
Figure 15:
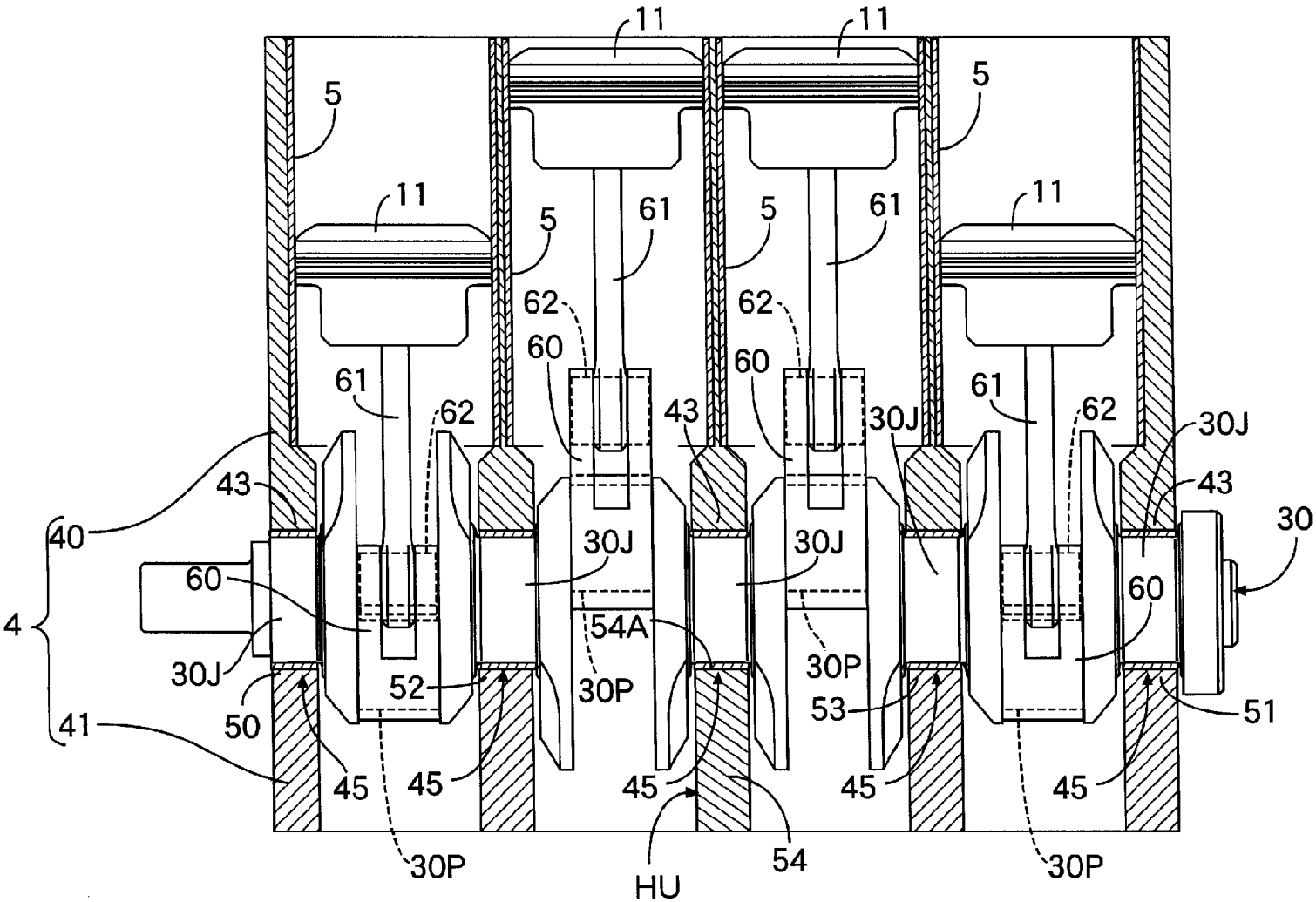
Figure 16:
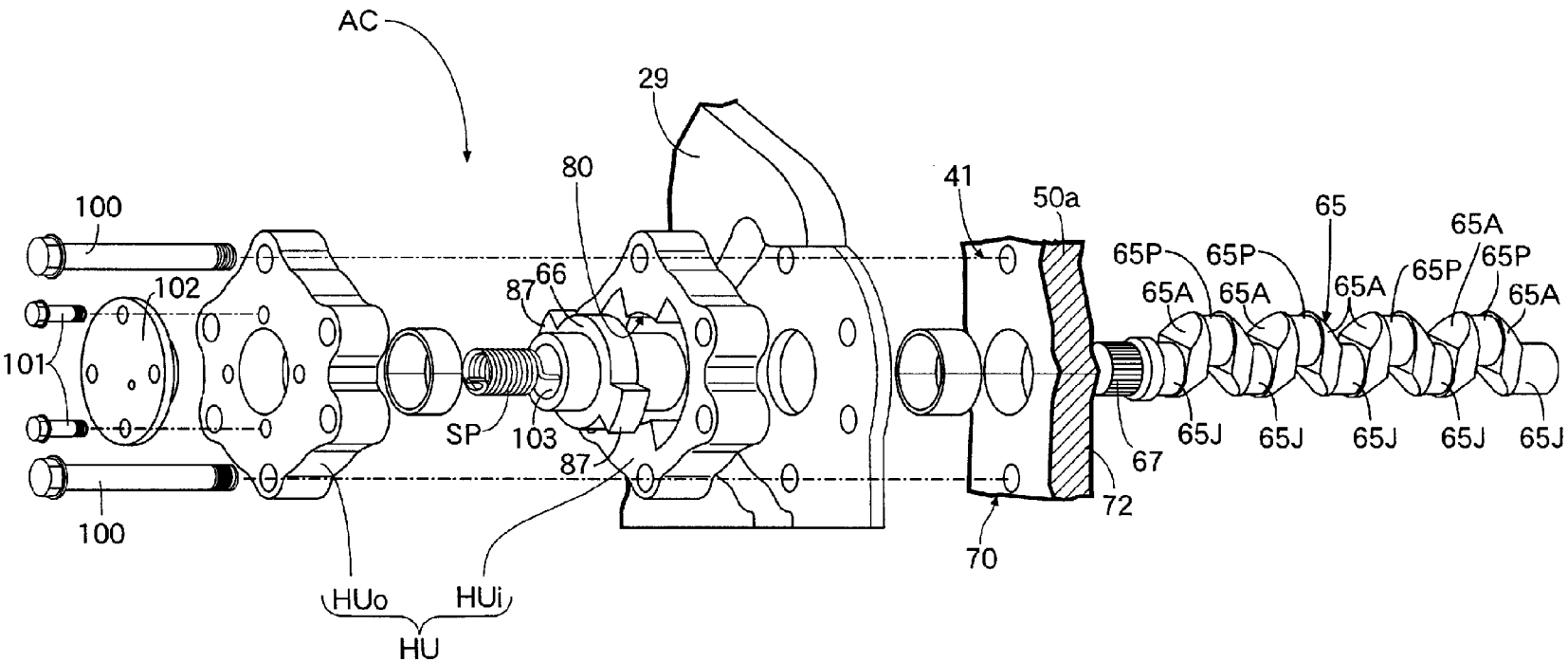
Figure 17:
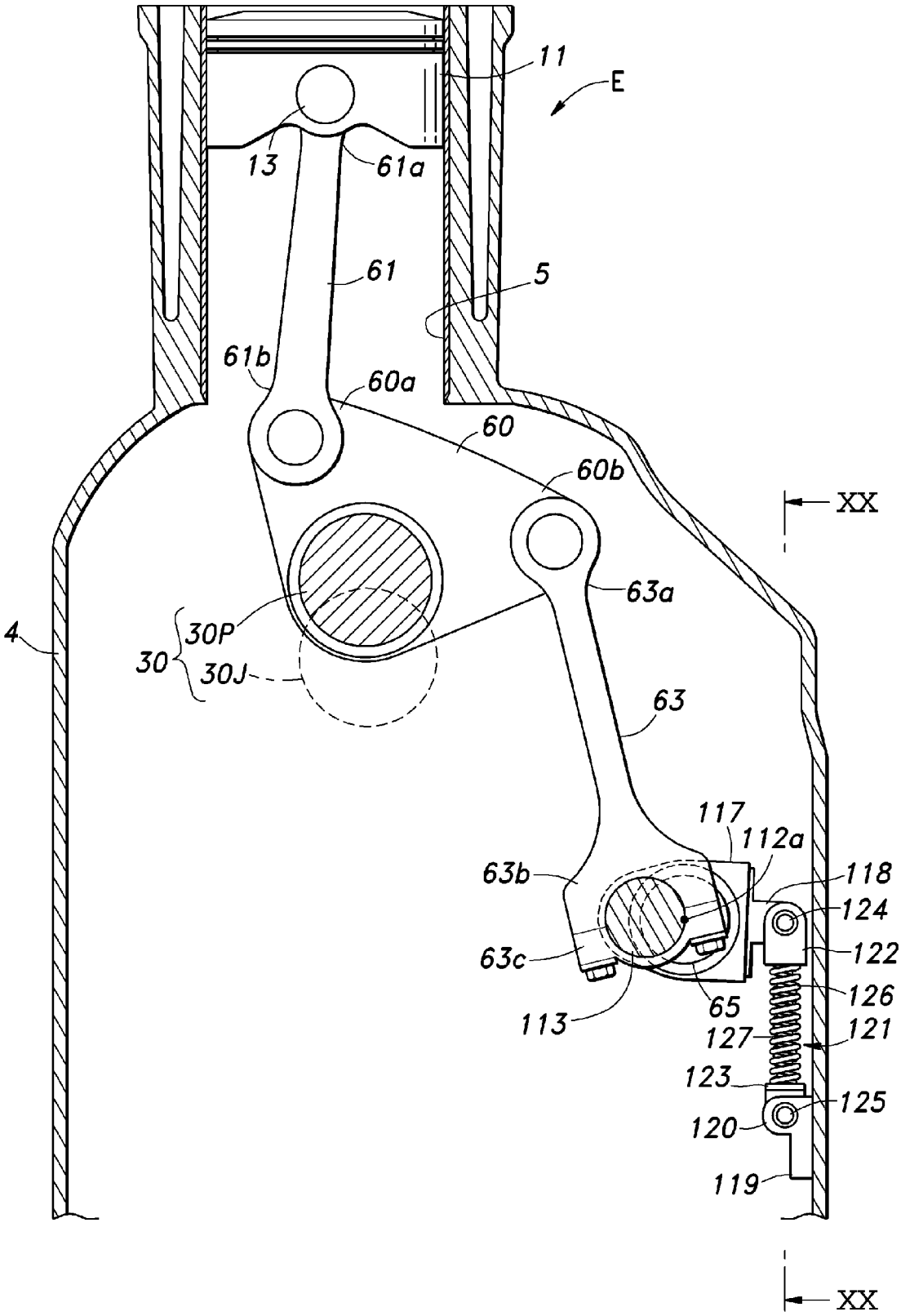
Figure 18:
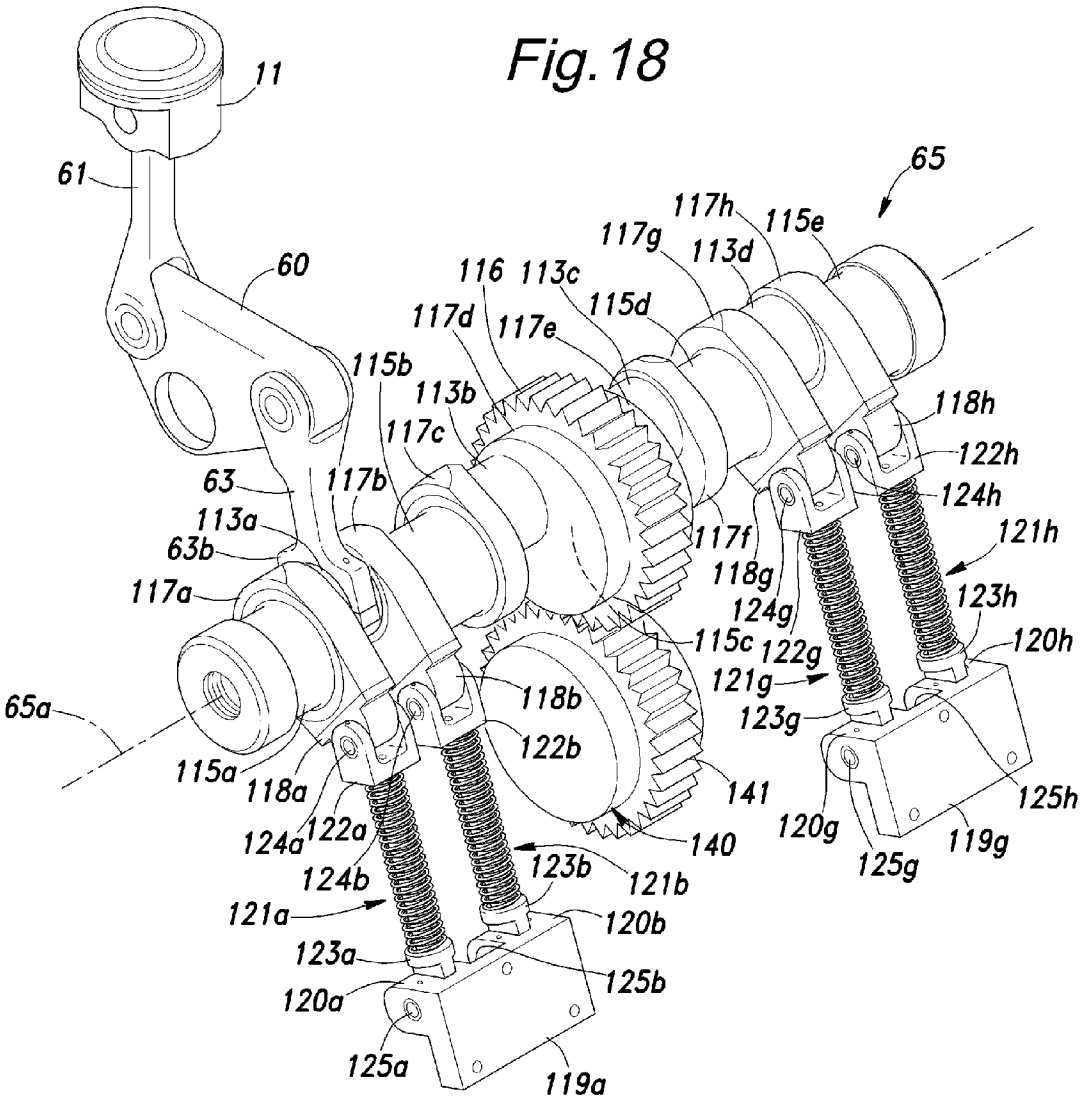
Figure 19:
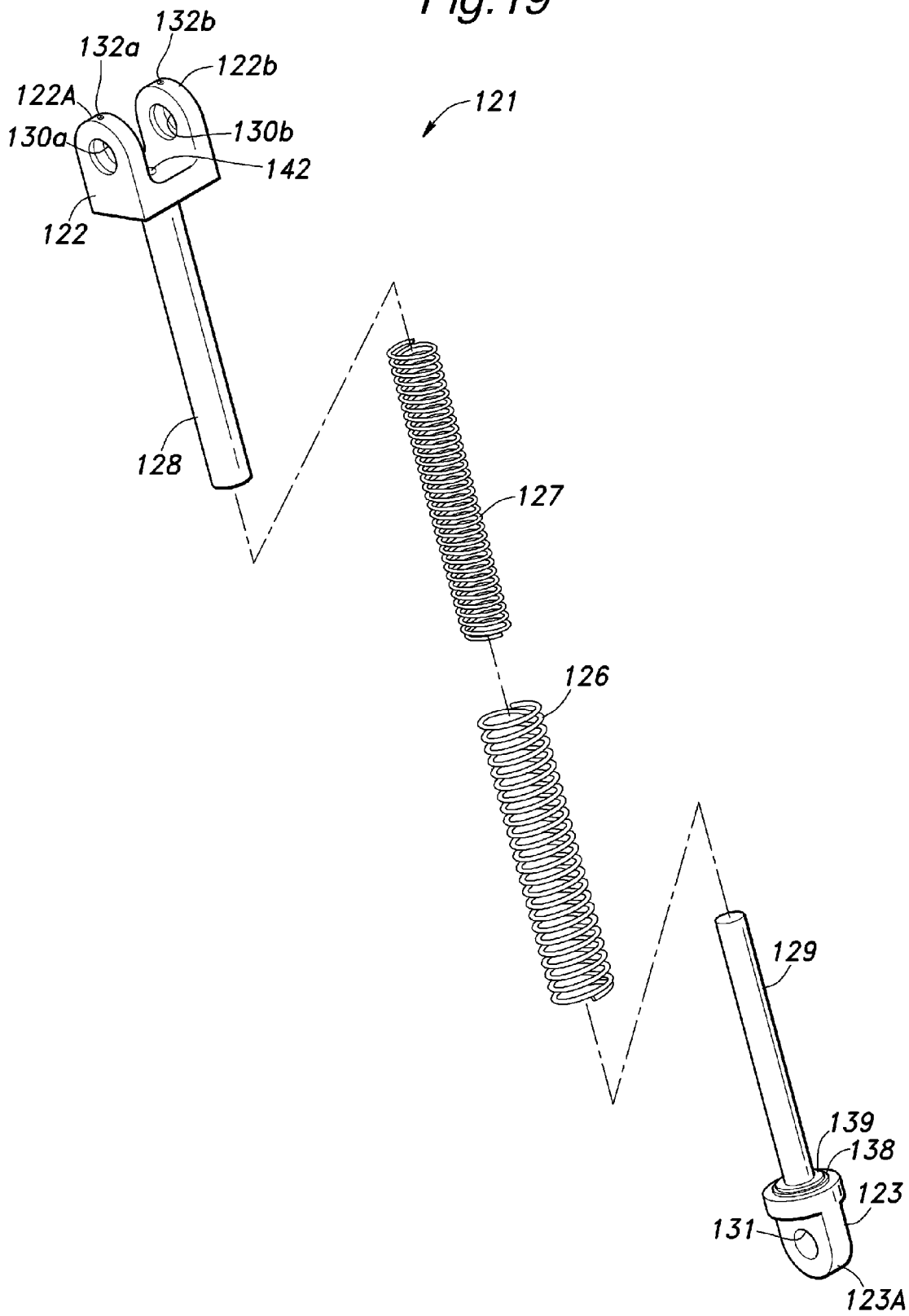
Figure 20:
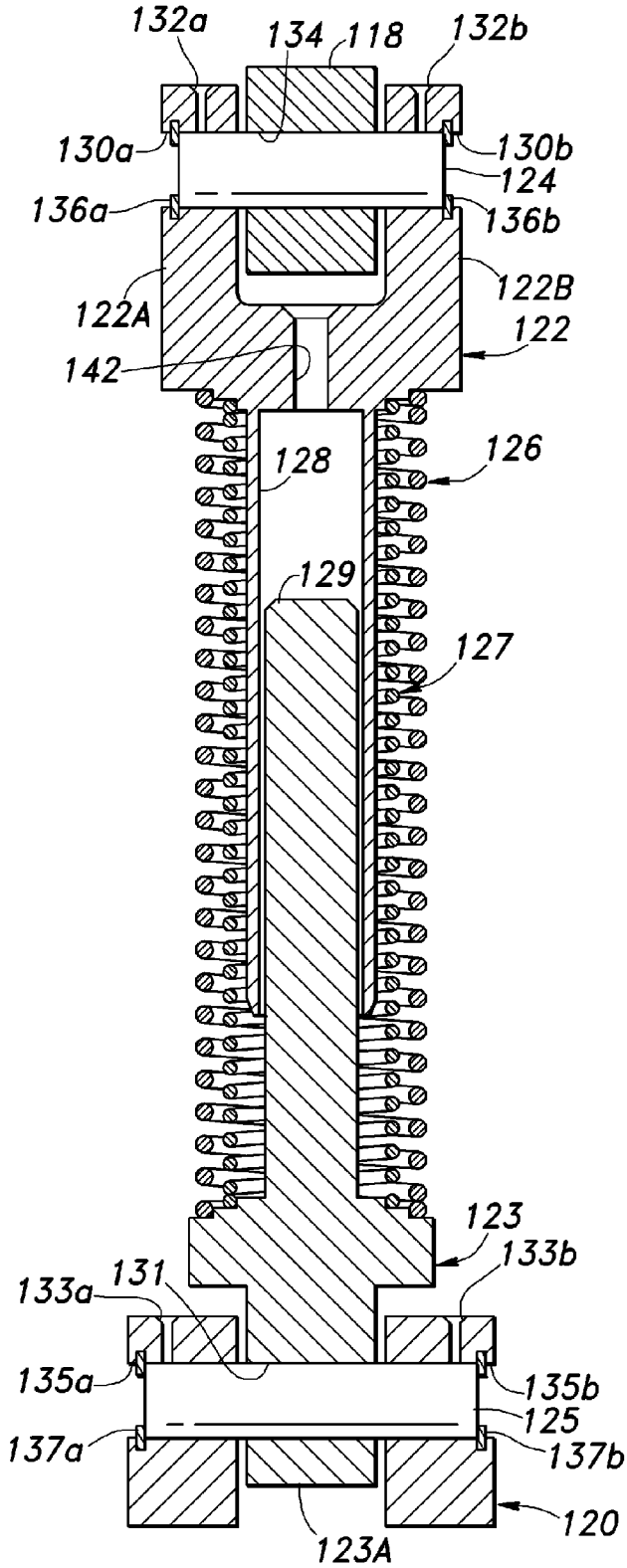
Figure 21:
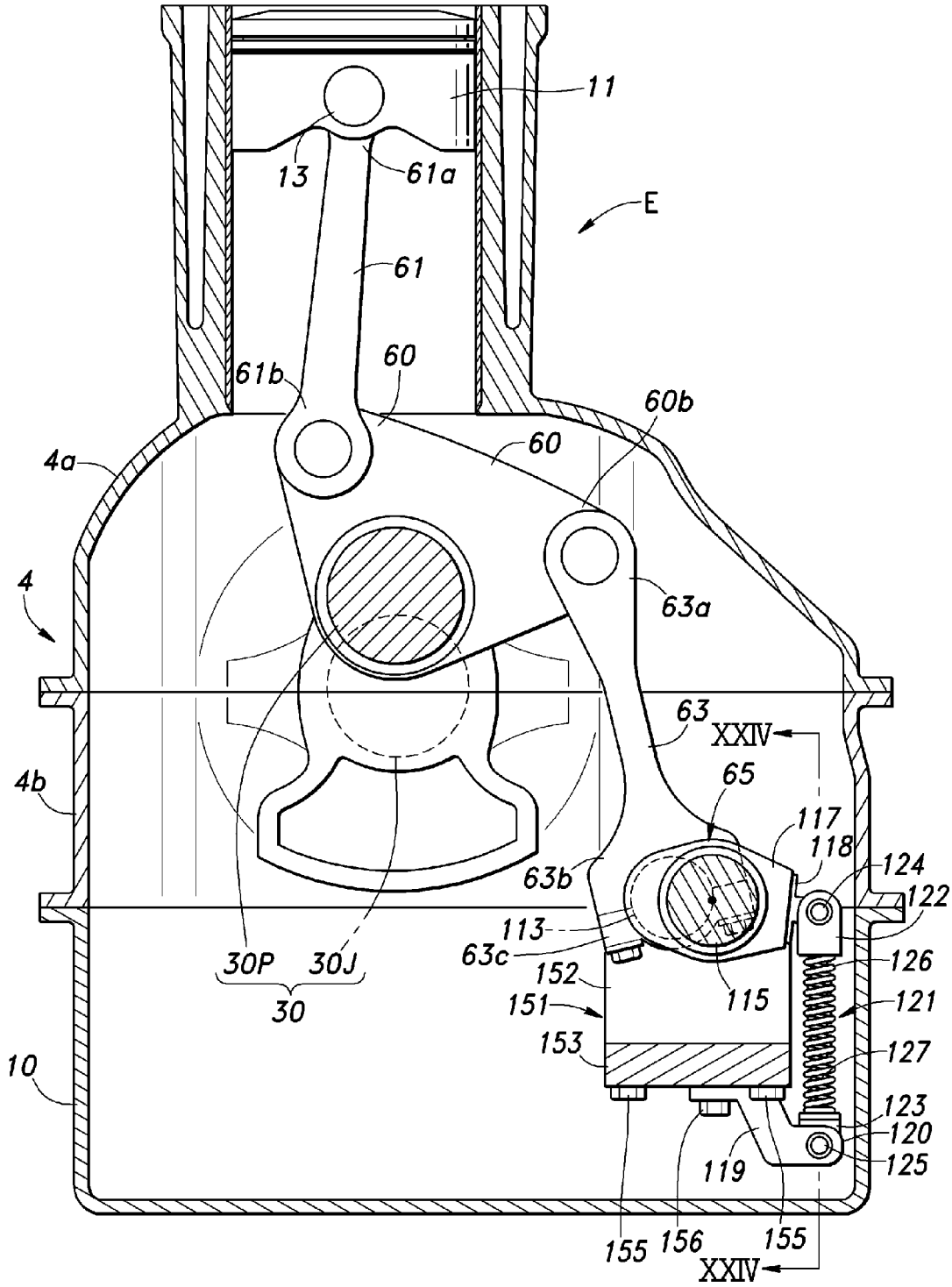
Figure 22:
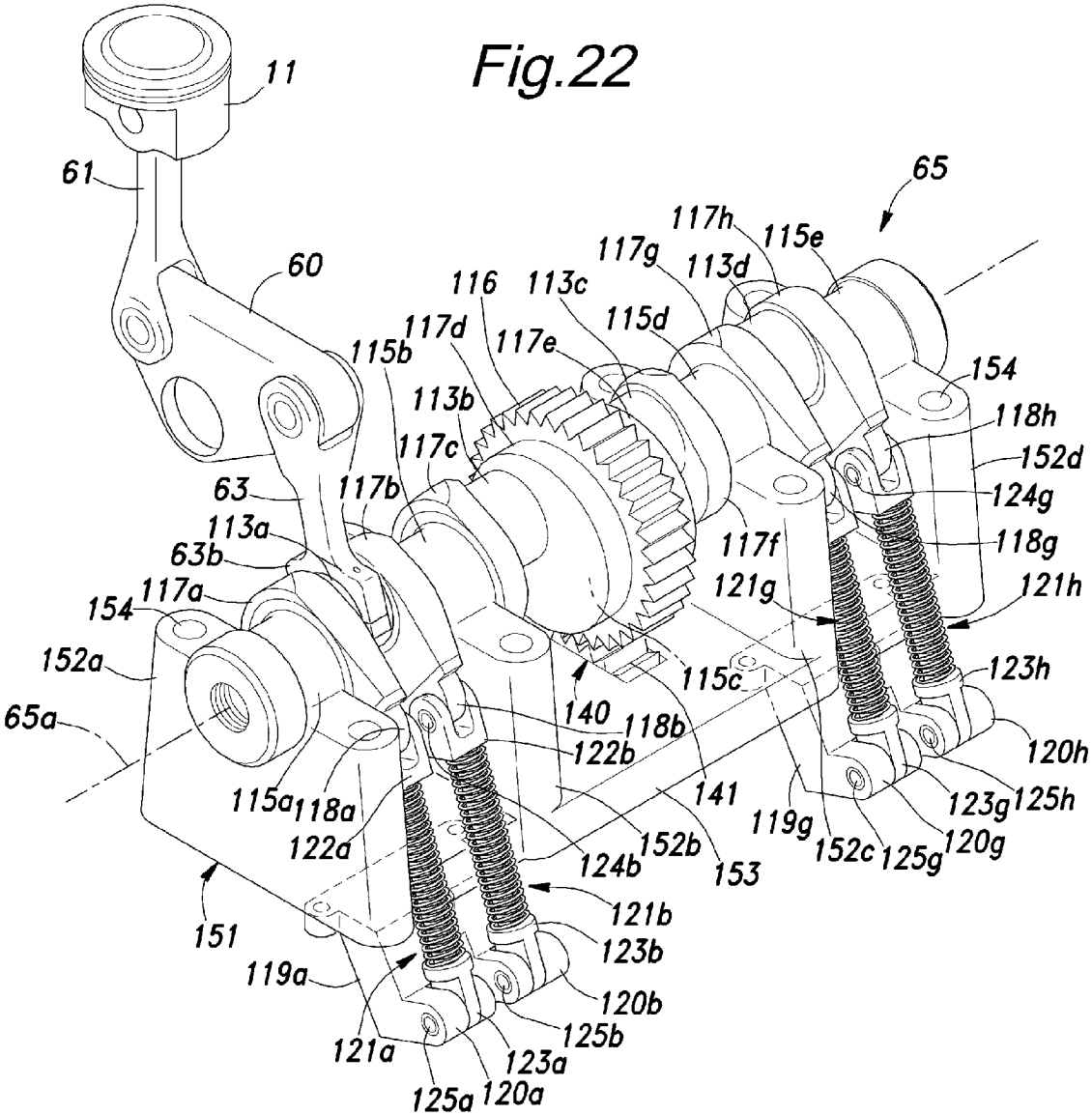
Figure 23:
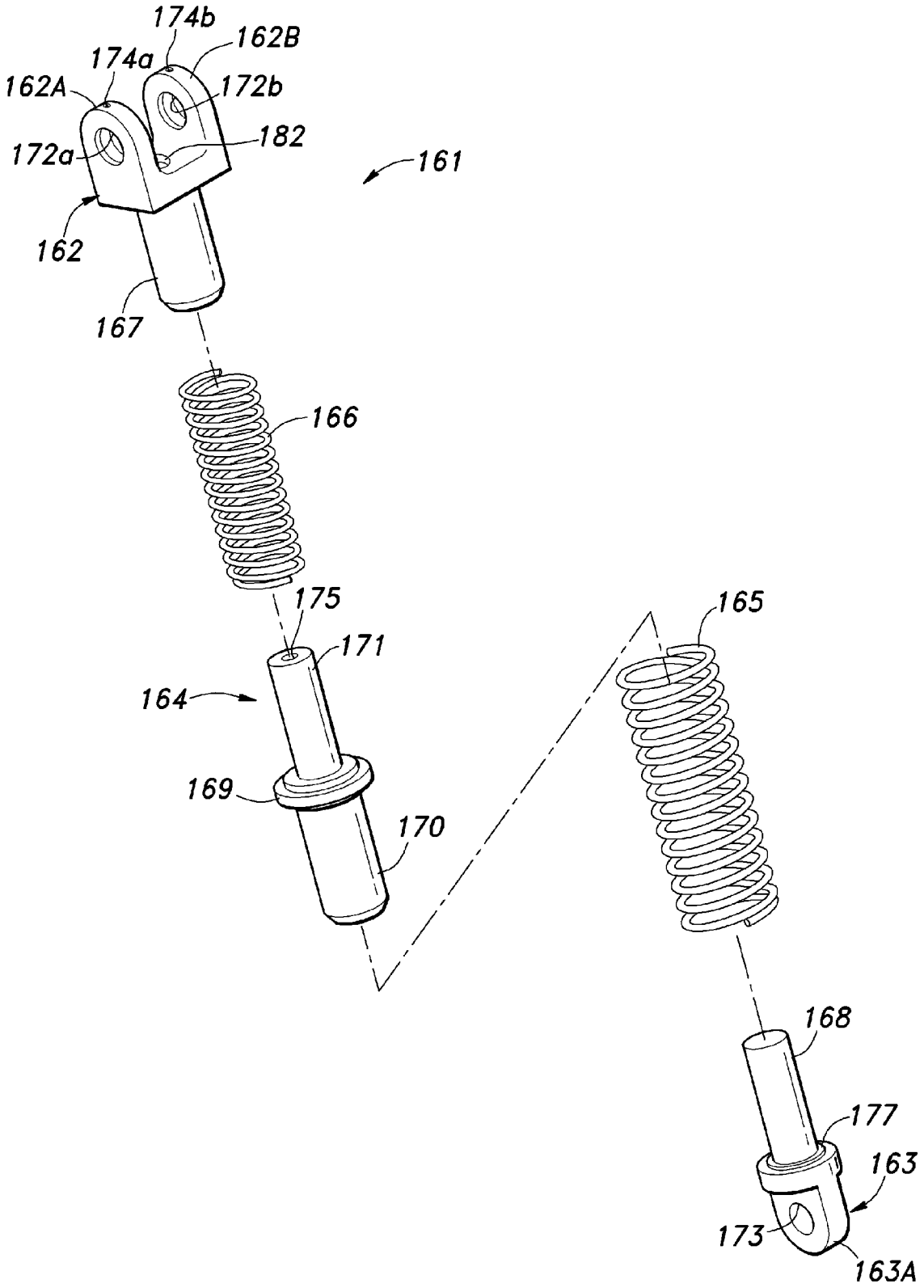
Figure 24:
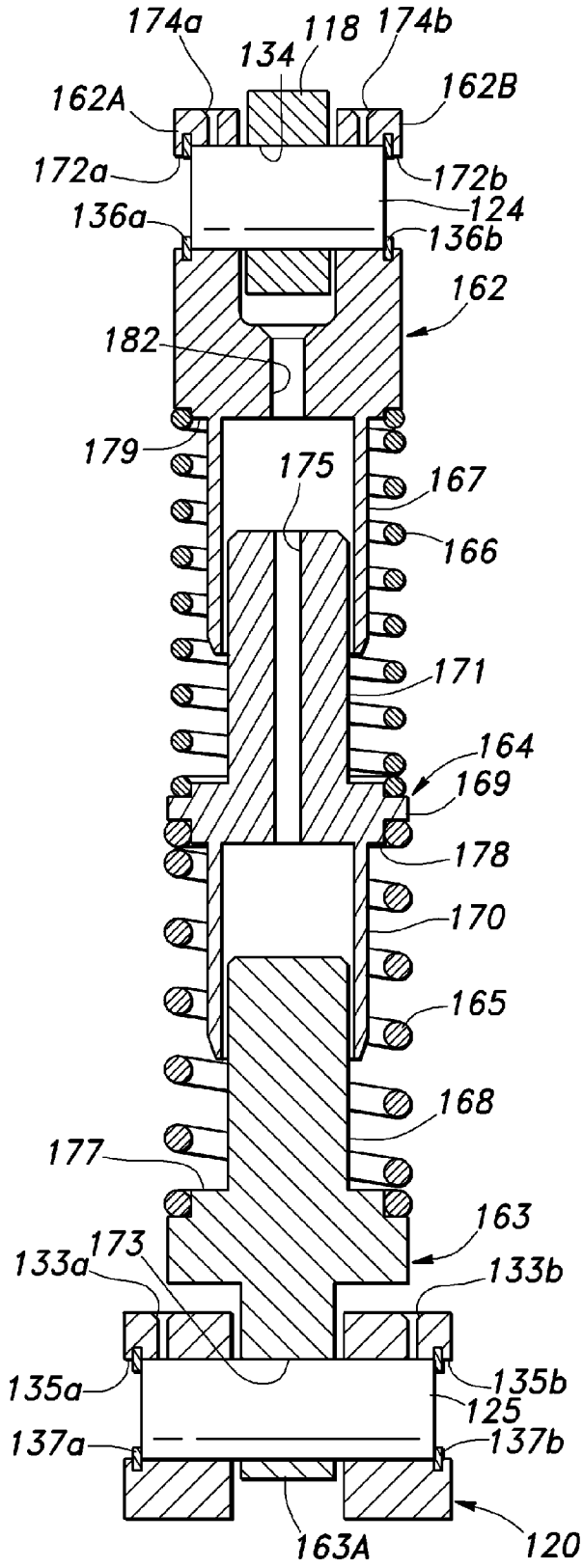
Figure 25:
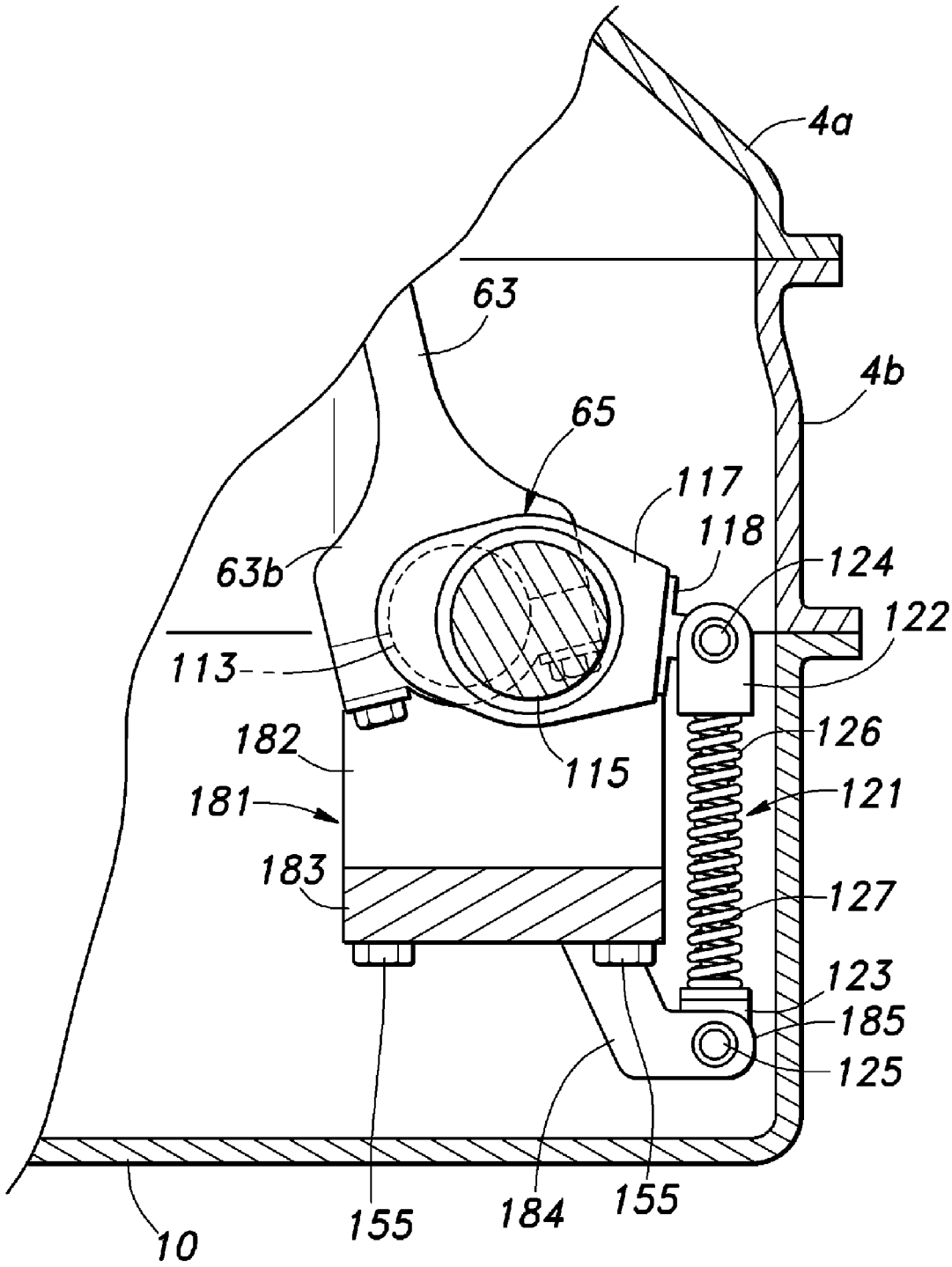

FIG. **6*a*** is a hydraulic circuit diagram showing the structure of the hydraulic ratchet mechanism;

FIG. **6*b*** is a hydraulic circuit diagram showing the structure of the vane-type hydraulic actuator;

FIG. 7 is an exploded perspective view of the hydraulic ratchet mechanism;

FIG. 8 is an overall perspective view of the variable stroke engine of the second embodiment of the present invention;

FIG. 9 is a view as seen from the direction indicated by IX in FIG. 8;

FIG. 10 is a sectional view taken along line X-X in FIG. 8 (high compression ratio condition);

FIG. 11 is a sectional view taken along line XI-XI in FIG. 8 (low compression ratio condition);

FIG. 12 is a horizontal sectional view taken along line XII-XII in FIG. 9;

FIG. 13 is a vertical sectional view taken along line XIII-XIII in FIG. 12;

FIG. 14 is a vertical sectional view taken along line XIV-XIV in FIG. 12;

FIG. 15 is a vertical sectional view taken along line XV-XV in FIG. 10;

FIG. 16 is an exploded perspective view of the vane type hydraulic actuator fitted with a spring member;

FIG. 17 is a vertical sectional view of the variable stroke engine given as the third embodiment of the present invention;

FIG. 18 is a perspective view showing the control shaft of the third embodiment;

FIG. 19 is an exploded perspective view of the compression coil spring device;

FIG. 20 is a sectional view taken along line XX-XX of FIG. 17;

FIG. 21 is a vertical sectional view of the variable stroke engine given as the fourth embodiment of the present invention;

FIG. 22 is a perspective view of the control shaft of the fourth embodiment;

FIG. 23 is an exploded perspective view of the compression coil spring device of a modified embodiment of the fourth embodiment;

FIG. 24 is a vertical sectional view of the compression coil spring device; and FIG. 25 is a fragmentary vertical sectional view of a part of the variable stroke engine given as another modified embodiment of the fourth embodiment.

The invention claimed is:

1. A variable stroke engine, comprising;

a plurality of links connecting a piston with a crankshaft;

a control member disposed on an engine main body so as to be moveable in two directions over a prescribed range relative to the engine main body;

a control link connecting one of the plurality of links with the control member; and an actuator for displacing the control member;

wherein the actuator comprises a hydraulic chamber separated into a first and second hydraulic chamber by a piston, a check valve having a first and second end, and a switching valve having three positions for selectively connecting the first and second chambers to the check valve, the three position including a first position connecting the first and second chambers with the first and second ends of the check valve, respectively, a second position connecting the first and second chambers with the second and first ends of the check valve, respectively, and a third position closing the first and second chambers, and wherein the first end is directly connected with the switching valve and the second end is directly connected with the switching valve such that the check valve is free of connection from an oil tank.

2. The variable stroke engine according to claim 1, further including a spring member that biases the control member in one of the two directions.

3. The variable stroke engine according to claim 2, wherein the spring member comprises a torsion coil spring.

4. The variable stroke engine according to claim 2, wherein the spring member acts upon the control member in such a direction as to urge the control member from a high compression position to a low compression ratio position.

5. The variable stroke engine according to claim 2, wherein the spring member is at least partly received in a part of the actuator.

6. The variable stroke engine according to claim 4, wherein the spring member is received at least partly received in a housing wall of the actuator, and has one end engaged by a drive shaft of the actuator and another end engaged by an engine main body.

7. The variable stroke engine according to claim 4, wherein the spring member is received at least partly received in drive shaft of the actuator, and has one end engaged by a drive shaft of the actuator and another end engaged by an engine main body or an housing of the actuator.

8. The variable stroke engine according to claim 7, wherein the spring member extends at least partly along a bearing journal of the drive shaft.

9. The variable stroke engine according to claim 7, wherein the one end the spring member is engaged by an engagement opening formed in an end wall of the drive shaft, and the other end thereof is engagement by an engagement openings formed in the housing of the actuator, the engagement openings both opening out outwardly so that states of engagement may be visible from exterior.

10. The variable stroke engine according to claim 2, wherein the control member comprises an eccentric portion of a control shaft, and the spring member comprises a compression coil spring interposed between an arm of the control shaft and an engine main body.

11. The variable stroke engine according to claim 2, wherein the control member comprises an eccentric portion of a control shaft, and the spring member comprises a tension coil spring interposed between an arm of the control shaft and an engine main body.

* * * * *